US011186968B2

(12) United States Patent
Ono et al.

(10) Patent No.: US 11,186,968 B2
(45) Date of Patent: Nov. 30, 2021

(54) WORKING MACHINE

(71) Applicant: KUBOTA CORPORATION, Osaka (JP)

(72) Inventors: Makoto Ono, Sakai (JP); Kenjiro Honda, Sakai (JP); Atsushi Matsumoto, Sakai (JP); Hiromichi Yoshida, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/664,126

(22) Filed: Oct. 25, 2019

(65) Prior Publication Data

US 2020/0056351 A1 Feb. 20, 2020

Related U.S. Application Data

(63) Continuation of application No. PCT/JP2018/016468, filed on Apr. 23, 2018.

(30) Foreign Application Priority Data

Apr. 28, 2017 (JP) ..... JP2017-090484
Apr. 28, 2017 (JP) ..... JP2017-090485
(Continued)

(51) Int. Cl.
*E02F 9/20* (2006.01)
*E02F 9/22* (2006.01)

(52) U.S. Cl.
CPC ..... *E02F 9/2246* (2013.01); *E02F 9/2066* (2013.01); *E02F 9/2221* (2013.01); *E02F 9/2235* (2013.01); *E02F 9/2296* (2013.01)

(58) Field of Classification Search
CPC ..... E02F 9/2066; E02F 9/2221; E02F 9/2235; E02F 9/2246; E02F 9/2296; F16H 61/478;
(Continued)

(56) References Cited

U.S. PATENT DOCUMENTS 5,029,067 A * 7/1991 Nishida ..... E02F 9/2235 60/421
5,630,317 A * 5/1997 Takamura ..... E02F 9/2235 60/445
(Continued)

FOREIGN PATENT DOCUMENTS

JP 4-265434 A 9/1992
JP 7-197907 A 8/1995
(Continued)

*Primary Examiner* — Michael Leslie
(74) *Attorney, Agent, or Firm* — Birch, Stewart, Kolasch & Birch, LLP.

(57) ABSTRACT

A working machine includes a prime mover, a hydraulic pump to be driven by power of the prime mover and to output operation fluid, a hydraulic actuator to be operated by the operation fluid, and a control device. The control device has a revolving-speed controller to increase and decrease a revolving speed of the prime mover, a first setting portion to set a limit value of the revolving speed of the prime mover, and a revolving-speed limiter to limit the revolving speed of the prime mover set by the revolving-speed controller to the limit value set by the first setting portion.

6 Claims, 25 Drawing Sheets

(30) Foreign Application Priority Data

Apr. 28, 2017 (JP) ..... JP2017-090486
Apr. 28, 2017 (JP) ..... JP2017-090487

(58) Field of Classification Search
CPC ..... F15B 2211/6323; F15B 2211/633; F15B 2211/6346
See application file for complete search history.

(56) References Cited

U.S. PATENT DOCUMENTS

| | | | | |
|---|---|---|---|---|
| 6,308,516 | B1 | 10/2001 | Kamada | |
| 8,056,331 | B2 * | 11/2011 | Kakizawa | E02F 9/2296 60/431 |
| 2006/0151230 | A1 | 7/2006 | Tatsuno et al. | |
| 2006/0230752 | A1 | 10/2006 | Sawada | |
| 2010/0281859 | A1 | 11/2010 | Oka | |
| 2015/0252820 | A1 | 9/2015 | Sugano et al. | |
| 2016/0032949 | A1 | 2/2016 | Ueda et al. | |

FOREIGN PATENT DOCUMENTS

| | | | |
|---|---|---|---|
| JP | 7-252862 | A | 10/1995 |
| JP | 2651077 | B2 | 9/1997 |
| JP | 11-336701 | A | 12/1999 |
| JP | 11-350538 | A | 12/1999 |
| JP | 3316053 | B2 | 8/2002 |
| JP | 3316057 | B2 | 8/2002 |
| JP | 2009-150553 | A | 7/2009 |
| JP | 2010-174574 | A | 8/2010 |
| JP | 2010-185257 | A | 8/2010 |
| JP | 2011-179280 | A | 9/2011 |
| JP | 2012-162917 | A | 8/2012 |
| JP | 2013-76311 | A | 4/2013 |
| JP | 2015-169306 | A | 9/2015 |
| JP | 2016-31125 | A | 3/2016 |
| WO | WO 2004/029434 | A1 | 4/2004 |
| WO | WO 2009/104313 | A1 | 8/2009 |

* cited by examiner

WORKING MACHINE

CROSS-REFERENCE TO RELATED APPLICATIONS

The present application is a continuation application of International Application No. PCT/JP 2018/016468, filed Apr. 23, 2018, which claims priority to Japanese Patent Application No. 2017/090486, filed Apr. 28, 2017, to Japanese Patent Application No. 2017/090484, filed Apr. 28, 2017, to Japanese Patent Application No. 2017/090485, filed Apr. 28, 2017, and to Japanese Patent Application No. 2017/090487, filed Apr. 28, 2017. The contents of these applications are incorporated herein by reference in their entirety.

BACKGROUND OF THE INVENTION

Field of the Invention

The present invention relates to a working machine such as a backhoe.

Description of Related Art

A working machine disclosed in Patent Document 1 (Japanese Patent Publication No. 3316057) is previously known.

The working machine disclosed in Patent Document 1 includes a variable displacement hydraulic pump, a hydraulic actuator, a command means to command operation of the hydraulic actuator, a load detection means to detect the load of the hydraulic actuator, an operation speed information detection means to detect a changing rate of an operation speed of the hydraulic actuator, and a target revolving speed setting means to set a target revolving speed of the prime mover according to the operation of the operation member. In the working machine, when the changing rate of the operation speed is equal to or greater than a predetermined value, the prime mover is controlled at the target revolving speed corrected based on the load of the hydraulic actuator. And, when the changing rate of the operation speed is smaller than a predetermined value, the prime mover is controlled at the original target revolving speed that has not been corrected yet.

SUMMARY OF THE INVENTION

A working machine includes: a prime mover; a hydraulic pump to be driven by power of the prime mover and to output operation fluid; a hydraulic actuator to be operated by the operation fluid; and a control device having: a revolving-speed controller part to increase and decrease a revolving speed of the prime mover; a first setting part to set a limit value of the revolving speed of the prime mover; and a revolving-speed limiter part to limit the revolving speed of the prime mover set by the revolving-speed controller part to the limit value set by the first setting part.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
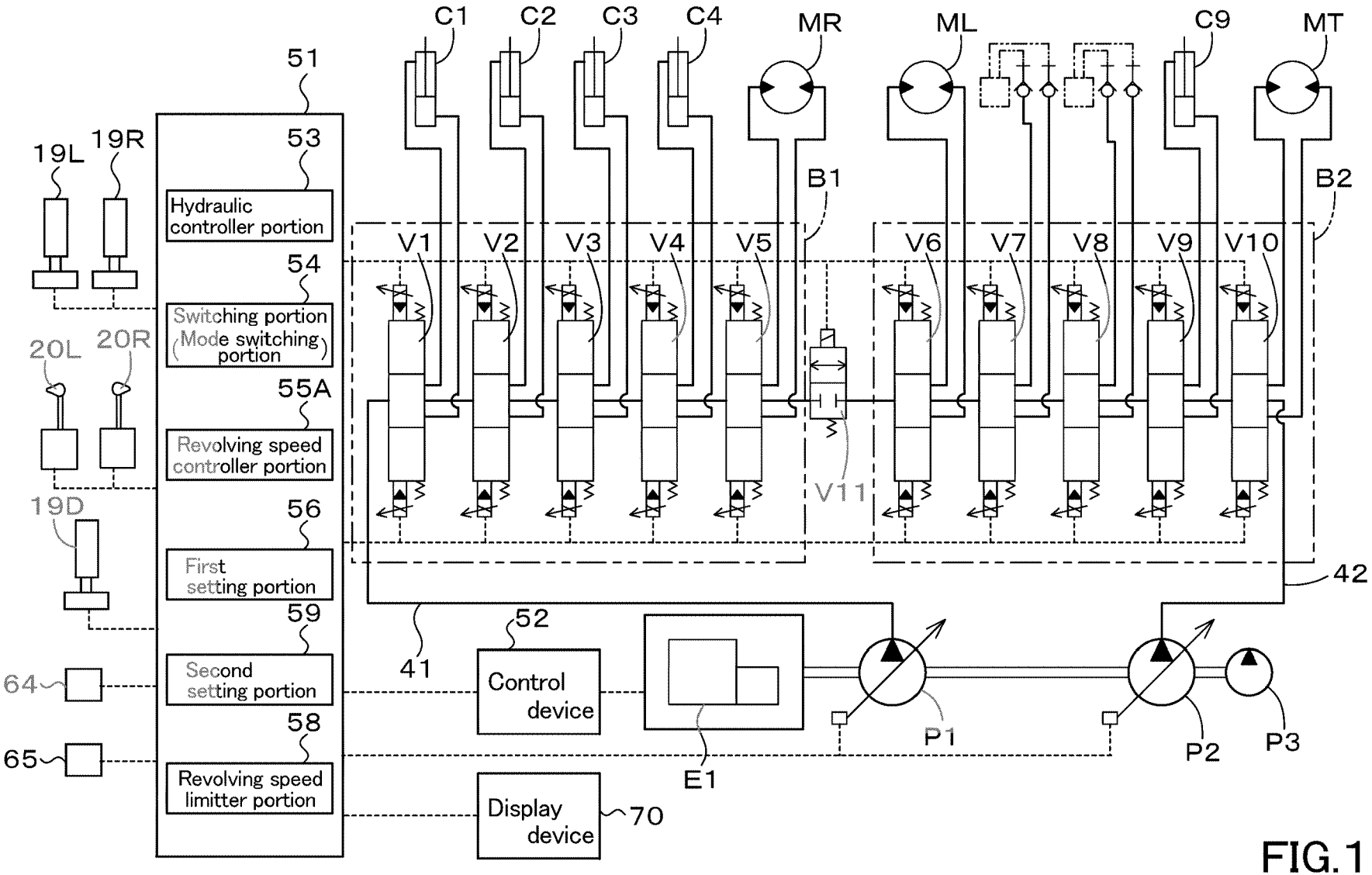
FIG. 1 is a schematic configuration view illustrating a hydraulic system and a control system of a working machine according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described with reference to the drawings as appropriate.

First Embodiment

Figure 20:
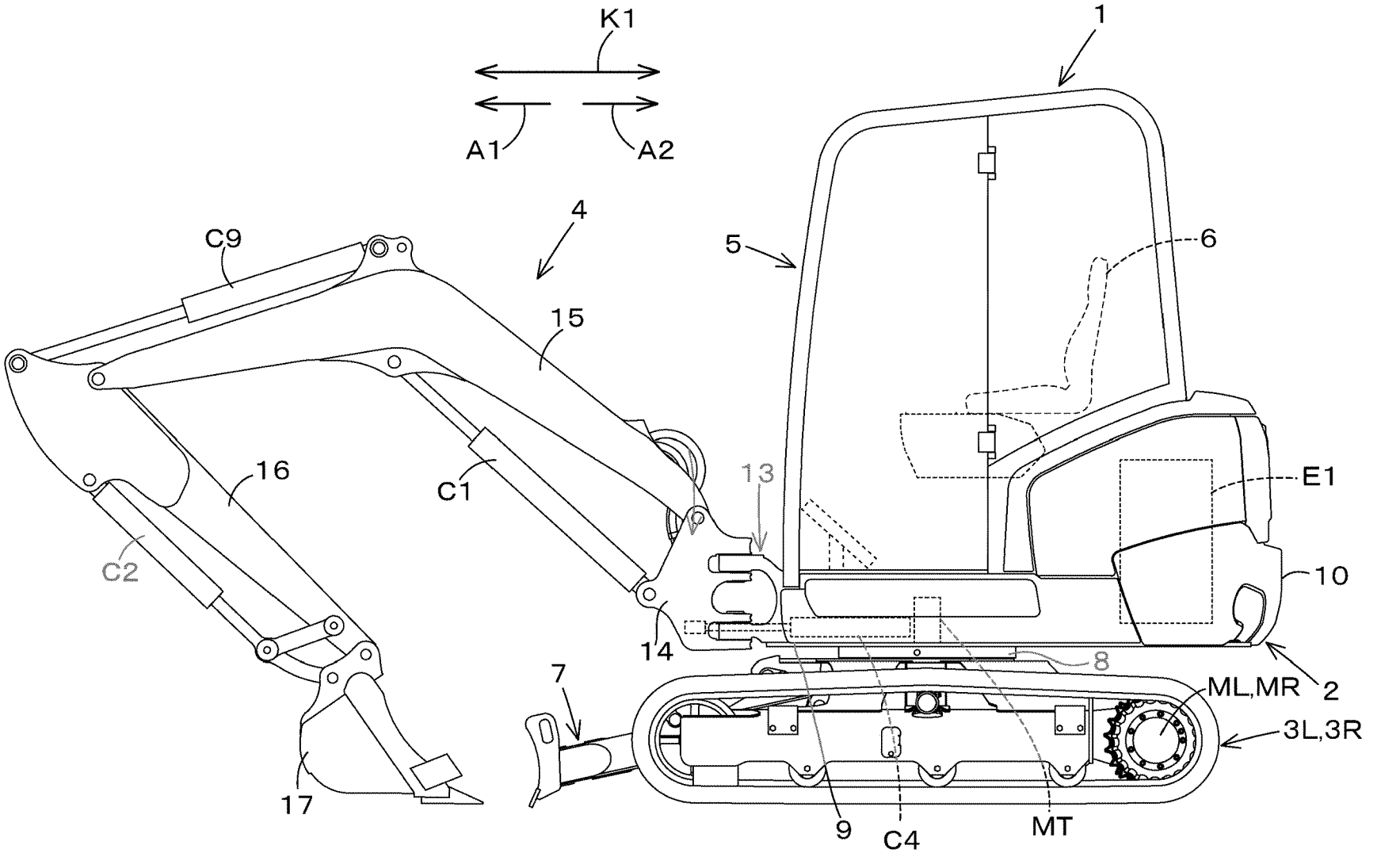
FIG. 20 is a whole side view of a backhoe according to the embodiments of the present invention.

FIG. 20 is a schematic side view showing the overall configuration of the working machine 1. In the present embodiment, a backhoe is illustrated as the working machine 1. The working machine 1 may be a front loader, a skid steer loader, a compact truck loader, or the like.

First, the overall configuration of the working machine 1 will be described.

As shown in FIG. 20, the working machine 1 includes a machine body (a turn base) 2, a first traveling device 3R, a second traveling device 3L, and a working device 4. A cabin 5 is mounted on the machine body 2. An operator seat (a seat) 6 on which a driver (an operator) seats is provided in the cabin 5.

In the present embodiment, the front side of the operator seating on the operator seat 6 of the working machine 1 (the direction of an arrowed line A1 in FIG. 20) will be referred to as the front, the rear side of the operator (the direction of an arrowed line A2 in FIG. 20) will be referred to as the rear, the left side of the operator (a front surface side of FIG. 20) will be referred to as the left, and the right side of the operator (a back surface side of FIG. 20) will be referred to as the right. The horizontal direction, which is a direction orthogonal to the front-rear direction K1, will be described as the machine width direction.

As shown in FIG. 20, the first traveling device 3R is arranged on the right side with respect to the machine body 2, and the second traveling device 3L is arranged on the left side with respect to the machine body 2. In the present embodiment, the first traveling device 3R and the second traveling device 3L are the crawler-type traveling mechanisms (the crawler-type traveling devices). The first traveling device 3R and the second traveling device 3L are driven by traveling motors MR and ML that are the traveling hydraulic actuators. A dozer device 7 is attached to the front portions of the first traveling device 3R and the second traveling device 3L. The dozer device 7 is configured to stretch and shorten a dozer cylinder C3 described below, thereby performing the lifting and the lowering (moving a blade upward and downward).

The machine body 2 is supported on a traveling frame by a turn bearing 8 so as to be able to turn about a vertical axis (an axis extending in the vertical direction). The machine body 2 is driven to turn by a turn motor MT constituted of a hydraulic motor (a hydraulic actuator). The machine body 2 includes a base plate 9 that turns around a vertical axis (hereinafter referred to as a swivel base plate), and includes a weight 10. The turn base plate 9 is formed of a steel plate or the like, and is coupled to the turn bearing 8. The weight 10 is arranged at the rear portion of the machine body 2. A prime mover E1 is mounted on the rear portion of the machine body 2. The prime mover E1 is an engine. The prime mover E1 may be an electric motor or may be a hybrid type having the engine and the electric motor.

The machine body 2 has a support bracket 13 at a front portion slightly rightward from the center in the machine width direction. A swing bracket 14 is attached to the support bracket 13 so as to be swingable about the vertical axis. The working device 4 is attached to the swing bracket 14.

The working device 4 includes a boom 15, an arm 16, and a bucket (a working tool) 17. The base portion of the boom 15 is pivotally attached to the swing bracket 14 so as to be rotatable about a lateral axis (an axis extending in the machine width direction). In this manner, the boom 15 is configured to be swung up and down. The arm 16 is pivotally attached to the tip end side of the boom 15 so as to be rotatable about the lateral axis. In this manner, the arm 16 is configured to be swung back and forth or up and down. The bucket 17 is arranged on the tip end side of the arm 16 so as to be configured to perform the shoveling operation and the dumping operation. The working machine 1 is configured to be provided with another working tool (the hydraulic attachment) that is configured to be driven by the hydraulic actuator, instead of or in addition to the bucket 17. Examples of the working tool include a hydraulic breaker, a hydraulic crusher, an angle broom, an earth auger, a pallet fork, a sweeper, a mower, and a snow blower.

The swing bracket 14 is configured to be swung by the stretching and shortening of a swing cylinder C4 provided in the machine body 2. The boom 15 is configured to be swung by the stretching and shortening of the boom cylinder C1. The arm 16 is configured to be swung by the stretching and shortening of the arm cylinder C9. The bucket 17 is configured to perform the shoveling performance and the dumping operation due to the stretching and shortening of a bucket cylinder (a working tool cylinder) C2. The working hydraulic actuators such as the swing cylinder C4, the boom cylinder C1, the arm cylinder C9, and the bucket cylinder C2 are constituted of the hydraulic cylinders.

FIG. 1 shows a hydraulic system and a control system of the working machine 1. The hydraulic system of the working machine 1 includes a first hydraulic pump P1, a second hydraulic pump P2, a third hydraulic pump P3, and a plurality of control valves V1 to V10. The first hydraulic pump P1 and the second hydraulic pump P2 are variable displacement hydraulic pumps. The third hydraulic pump P3 is a constant displacement hydraulic pump (a fixed displacement hydraulic pump). The first hydraulic pump P1, the second hydraulic pump P2, and the third hydraulic pump P3 are driven by the power of the engine E1 to output the operation fluid stored in the operation fluid tank. In this embodiment, the hydraulic system of the working machine 1 includes three hydraulic pumps (the first hydraulic pump P1, the second hydraulic pump P2, and the third hydraulic pump P3), but the number of the hydraulic pumps is not limited thereto.

Each of the plurality of control valves V1 to V10 is a valve (an electromagnetic control valve) configured to control the flow rate of operation fluid that is supplied to the hydraulic actuators (the working hydraulic actuators, the traveling hydraulic actuators). Each of the plurality of control valves V1 to V10 is an electromagnetic three-position switching valve whose spool positions are changed by the operation fluid (the pilot fluid) supplied from the third hydraulic pump P3. That is, each of the plurality of control valves V1 to V10 has an electromagnetic valve, and changes the pressure of pilot fluid acting on the spool in accordance with the opening aperture of the electromagnetic valve, and thereby changing the position of the spool. In addition, in this embodiment, although the electromagnetic three-position switching valve incorporating the electromagnetic valve is described, the electromagnetic valve may be configured separately from the three-position switching valve. Further, each of the plurality of control valves V1 to V10 may be a two-position switching valve, a four-position switching valve, or the like which are other than the three-position switching valve, and is not limited thereto.

The plurality of control valves V1 to V10 include a boom control valve V1 for controlling the boom cylinder C1, a bucket control valve V2 for controlling the bucket cylinder C2, a dozer control valve V3 for controlling the dozer cylinder C3, a swing control valve V4 for controlling the swing cylinder C4, a right traveling control valve V5 for controlling the traveling hydraulic actuator (a traveling motor MR) of the first traveling device 3R, a left traveling control valve V6 for controlling the traveling hydraulic actuator (a traveling motor ML) of the second traveling device 3L, a first SP control valve V7 for controlling the auxiliary actuator, a second SP control valve V8 for controlling the auxiliary actuator, an arm control valve V9 for controlling the arm cylinder C9, and a turn control valve V10 for controlling the turn motor MT.

The first output fluid tube 41 connected to the first hydraulic pump P1 is connected to the boom control valve V1, the bucket control valve V2, the dozer control valve V3, the swing control valve V4, and the right traveling control valve V5. The second output fluid tube 42 connected to the second hydraulic pump P2 is connected to the left traveling control valve V6, the first SP control valve V7, the second SP control valve V8, the arm control valve V9, and the turn control valve V10.

Hereinafter, for convenience of the explanation, a group of the boom control valve V1, the bucket control valve V2, the dozer control valve V3, the swing control valve V4, and the right traveling control valve V5 may be referred to as a first block B1, and a group of the left traveling control valve V6, the first SP control valve V7, the second SP control valve V8, the arm control valve V9, and the turn control valve V10 may be referred to as a second block B2.

A communication valve V11 is provided between the first block B1 and the second block B2. The communication valve V11 is a switching valve configured to be switched between a first position and a second position, and is connected to a first output fluid tube 41 and a second output fluid tube 42. When the communication valve V11 is in the first position, the first output fluid tube 41 and the second output fluid tube 42 are connected through the communication valve V11. And, when the communication valve V11 is in the second position, the communication between the first output fluid tube 41 and the second output fluid tube 42 is blocked by the communication valve V11. The communication valve V11 may be a three-position switching valve, a four-position switching valve, or the like which are other than the two-position switching valve, and is not limited thereto.

The working machine 1 includes a turn device. The turn device is a device including a machine body (a turn base) 2, a turn motor MT, and the hydraulic pumps (the first hydraulic pump P1, the second hydraulic pump P2).

Next, the configuration of the control system of the working machine 1 will be described.

As shown in FIG. 1, the control system of the working machine 1 includes a plurality of control devices 51 and 52. The control device 51 is a working control device configured to mainly control the hydraulic system, and includes a hydraulic controller portion 53. The hydraulic controller portion 53 is constituted of an electronic/electric circuit, a computer program, or the like which is provided in the control device 51. The hydraulic controller portion 53 controls the hydraulic equipment provided in the working machine 1, for example, the plurality of control valves V1 to V10, the communication valve V11, and the hydraulic pumps (the first hydraulic pump P1 and the second hydraulic pump P2). The hydraulic controller portion 53 may be anything as long as it controls the hydraulic equipment, and the control target is not limited to that of this embodiment. The control device 52 is an engine control device 52 configured to control the engine E1. In this embodiment, the control system includes the plurality of control devices 51 and 52. However, the control devices 51 and 52 may be configured by a single of control device, and the number of the control device is not limited thereto.

The control device 51 is connected to work operating members (a work operating member 19L, a work operating member 19R, a work operating member 19D). The work operating member 19L is arranged on the left side of the operator seat 6, the work operating member 19R is arranged on the right side of the operator seat 6, and the work operating member 19D is arranged on the right side of the operator seat 6 separately from the work operating member 19R. The work operating member 19L and the work operating member 19R are levers each having a potentiometer (a detector device) configured to detect a swing amount (the operating extent), and are levers that can swing to the front, the rear, the right, and the left. The work operating member 19D is a lever having a potentiometer (a detector device) configured to detect a swing amount (the operating extent), and is a lever that can swing back and forth.

When a worker (an operator) or the like operates the work operating member 19L, the operating extent and the operation direction of the work operating member 19L are detected by the potentiometer, and the detected operating extent and operation direction are inputted to the control device 51. The hydraulic controller portion 53 magnetizes the solenoid of the turn electromagnetic valve of the turn control valve V10 in accordance with the operating extent and the operation direction of the work operating member 19L, and thereby controls the opening aperture of the turn electromagnetic valve. Or, the hydraulic controller portion 53 magnetizes the solenoid of the arm solenoid valve of the arm control valve V9, and thereby controls the opening aperture of the arm solenoid valve. As the result, the pilot pressure acts on the pressure receiving portion of the turn control valve V10, the position of the turn control valve V10 is switched, and then the rotation direction of the turn motor MT is switched in accordance with the position of the turn control valve V10. Or, the pilot pressure acts on the pressure receiving portion of the arm control valve V9, the position of the arm control valve V9 is switched, and then the arm cylinder C9 is stretched and shortened in accordance with the position of the arm control valve V9.

When the operator or the like operates the work operating member 19R, the operating extent and operation direction of the work operating member 19R are detected by the potentiometer, and the detected operating extent and operation direction are inputted to the control device 51. The hydraulic controller portion 53 magnetizes the solenoid of the boom solenoid valve of the boom control valve V1 in accordance with the operating extent and the operation direction of the work operating member 19R, and then controls the opening aperture of the boom solenoid valve. Or, the hydraulic controller portion 53 magnetizes the solenoid of the bucket electromagnetic valve of the bucket control valve V2 in accordance with the operating extent and operation direction of the work operating member 19R, and thereby controls the opening aperture of the bucket electromagnetic valve. As the result, the pilot pressure acts on the pressure receiving portion of the boom control valve V1, the position of the boom control valve V1 is switched, and then the boom cylinder C1 is stretched and shortened in accordance with the position of the boom control valve V1. Or, the pilot pressure acts on the pressure receiving portion of the bucket control valve V2, the position of the bucket control valve V2 is switched, and then the bucket cylinder C2 is stretched and shortened in accordance with the position of the bucket control valve V2.

When the operator or the like operates the work operating member 19D, the operating extent and operation direction of the work operating member 19D are detected by the potentiometer, and the detected operating extent and operation direction are inputted to the control device 51. The hydraulic controller portion 53 magnetizes a solenoid of a dozer solenoid valve of the dozer control valve V3 in accordance with to the operating extent and operation direction of the work operating member 19D, and thereby controls the opening aperture of the dozer solenoid valve. As the result, the pilot pressure acts on the pressure receiving portion of the dozer control valve V3, the position of the dozer control valve V3 is switched, and thereby the dozer cylinder C3 is stretched and shortened in accordance with the position of the dozer control valve V3.

As described above, by operating the work operating members (the work operating member 19L, the work operating member 19R, the work operating member 19D), the machine body 2, the boom 15, the arm 16, the bucket (the working tool) 17, and the dozer device 7 can be operated.

The travel operating members (the travel operating member 20L, the travel operating member 20R) are connected to the control device 51. The travel operating member 20L and the travel operating member 20R are arranged in front of the operator seat 6. The travel operating member 20L and the travel operating member 20R are levers each having a potentiometer (a detector device) configured to detect a turn amount (the operating extent), and are levers can be swung back and forth.

When an operator or the like operates the travel operating member 20L and the travel operating member 20R, the operating extent and the operation direction of the travel operating member 20L and the travel operating member 20R are detected by the potentiometer, and the detected operating extent and operation direction are inputted to the control device 51. The hydraulic controller portion 53 magnetizes a solenoid of the left traveling electromagnetic valve of the left traveling control valve V6 in accordance with the operating extent and operation direction of the travel operating member 20L, and magnetizes a solenoid of the right traveling electromagnetic valve of the right traveling control valve V5 in accordance with the operating extent and operation direction of the travel operating member 20R. As the result, the pilot pressure acts on the pressure receiving portions of the right traveling control valve V5 and the left traveling control valve V6, each of the right traveling control valve V5 and the left traveling control valve V6 is switched, and thereby the rotation directions of the traveling motor MR and the traveling motor ML are determined.

As described above, when the work operating members (the work operating member 19L, the work operating member 19R, the work operating member 19D) and the travel operating members (the travel operating member 20L, the travel operating member 20R) are operated, the control device 51 outputs a control signal for magnetizing the solenoid or demagnetizing the solenoid. In this manner, the machine body 2, the boom 15, the arm 16, the bucket (the working tool) 17, the dozer device 7, the first traveling device 3R, and the second traveling device 3L can be controlled.

The control device 51 has two control modes (a first control mode and a second control mode), and the control mode for the working machine 1 differs depending on the control modes.

A switching member 65 is connected to the control device 51. The switching member 65 is, for example, an ON/OFF switch that is provided in the vicinity of the operator seat 6 and can be switched by a manual operation by a worker (an operator). Note that the switching member 65 may be arranged inside the control device 51 so that the switching member 65 cannot be manually operated by the operator.

The control device 51 is provided with a switching portion (mode switching portion) 54 that operates in response to the switching of the switching member 65. The switching portion 54 is constituted of an electronic/electric circuit, a computer program, and the like provided in the control device 51. When the switching member 65 is turned on, the switching portion 54 of the control device 51 sets the control device 51 to be in the first mode, and when the switching member 65 is turned off, the switching portion 54 of the control device 51 sets the control device 51 to be in the second mode. That is, the switching portion 54 has a first state (an integrated control mode) in which the engine revolving speed is increased or decreased according to the load by a revolving speed controller portion 55A described later, and includes a second state (a standard control mode) in which the engine revolving speed is not increased or decreased regardless of the load, and is configured to be switched between the first state and the second state according to the switching of the switching member 65 of the control device 51.

When the control device 51 is set to be in the second mode (the standard control mode), the control device 51 outputs, to the control device 52, a control signal to maintain the engine revolving speed at a predetermined engine revolving speed (the target engine revolving speed set by the accelerator setting member 64 connected to the control device 51). In the standard control mode, the control device 51 (the hydraulic controller portion 53) controls the plurality of control valves V1 to V10 and the like in accordance with the operating extents of the work operating member and the travel operating member as described above.

Further, in the standard control mode, the control device 51 (the hydraulic controller portion 53) obtains the flow rate of the operation fluid to be outputted from the hydraulic pumps (the first hydraulic pump P1 and the second hydraulic pump) based on the operating extents of the work operating member and the travel operating member, and then controls the swash plate angle of the hydraulic pump (the first hydraulic pump P1 and the second hydraulic pump) so as to output the obtained flow rate.

The example in which the hydraulic controller portion 53 obtains the flow rate of the operation fluid to be outputted from the hydraulic pumps based on the operating extents of the work operating member and the travel operating member, and then controls the swash plate angle in the standard control mode is shown. However, instead of that, a load sensing system having a pressure compensation valve may be provided in the hydraulic system of the working machine 1. In that configuration, the load pressures detected from the control valves V1 to V11 may be detected by the detection fluid tube, and then the swash plate angle of the hydraulic pump may be controlled by a regulator in accordance with the PPS signal and the PLS signal detected by the detection fluid tube. The swash plate angle of the hydraulic pump may be controlled by other methods, and the methods for controlling the swash plate angle of the hydraulic pump is not limited thereto. The accelerator setting member 64 described above is, for example, a lever, a volume switch, or the like provided in the vicinity of the operator seat 6, and the target engine revolving speed is set by the operation of the operator.

Figure 2A:
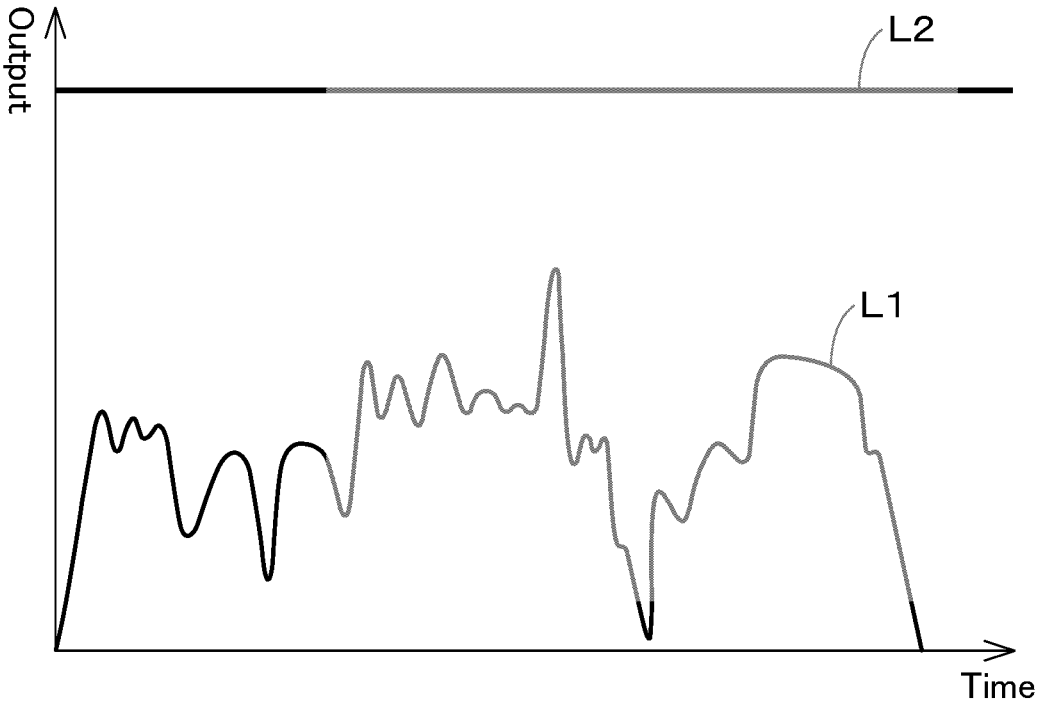
FIG. 2A is a view illustrating a relation between a load and a target engine revolving speed in a standard control mode according to the first embodiment.

FIG. 2A shows a relation between a load line L1 indicating a load (a load applied to the hydraulic pump) in the standard control mode and a target line L2 indicating a target engine revolving speed. As shown in FIG. 2A, in the standard control mode, even when the load line L1 is varied in operation of the hydraulic actuators (the working hydraulic actuator and the traveling hydraulic actuator), the target engine revolving speed is not changed regardless of the load. That is, the target engine revolving speed outputted to the control device 52 is fixed to be constant (the target line L2 is constant).

That is, in the standard control mode, the control device 51 outputs the target engine revolving speed (an ordered revolving speed) instructed by the accelerator setting member 64, which is a fixed value, directly as the target engine revolving speed (the target line L2: an outputted revolving speed). Then, the traveling hydraulic actuator and the working hydraulic actuator are controlled while performing the feedback control to control the actual engine revolving speed to be the target engine revolving speed.

Figure 2B:
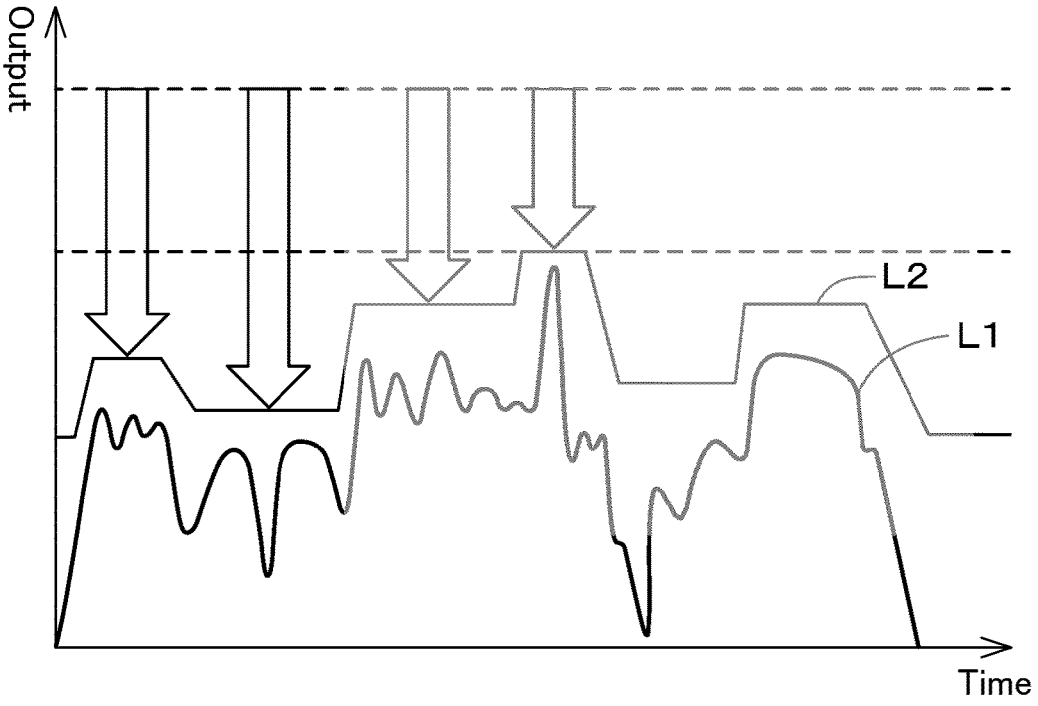
FIG. 2B is a view illustrating a relation between the load and the target engine revolving speed in an integrated control mode according to the first embodiment.

On the other hand, as shown in FIG. 2B, when the control device 51 is set to be in the first mode (the integrated control mode), the control device 51 ignores the target engine revolving speed (the ordered revolving speed) set by the accelerator setting member 64, and changes, in accordance with the load line L1, the target engine revolving speed (the outputted revolving speed) to be outputted to the control device 52.

The engine revolving control in the integrated control mode is performed by the revolving speed controller portion 55A provided in the control device 51. The revolving speed controller portion 55A is constituted of an electronic/electric circuit, a computer program, or the like provided in the control device 51. The revolving speed controller portion 55A increases or decreases the target engine revolving speed in accordance with at least the load applied to the hydraulic pumps (the first hydraulic pump P1 and the second hydraulic pump P2). In particular, the revolving speed controller portion 55A obtains the flow rate of operation fluid outputted from the hydraulic pumps (the first hydraulic pump P1 and the second hydraulic pump P2), that is, obtains a required flow rate based on the operating extent of the work operating member and on the operating extent of the travel operating member. And then, the revolving speed controller portion 55A calculates a target engine revolving speed based on the required flow rate.

In particular, the revolving speed controller portion 55A obtains a required flow rate Q1 to be supplied to the hydraulic actuators (the boom cylinder C1, the bucket cylinder C2, the dozer cylinder C3, the swing cylinder C4, and the traveling motor MR) corresponding to the first block B1 (the boom control valve V1, the bucket control valve V2, the dozer control valve V3, the swing control valve V4, and the right traveling control valve V5). The required flow rate Q1 may be obtained, for example, by calculating the respective opening apertures of the control valves V1 to V5 based on the operating extents of the work operating member and the travel operating member, obtaining the flow rates of the control valves V1 to V5 based on the relation between the respective opening apertures and values Cv (capacity coefficients) of the control valves V1 to V5, and then totalizing the flow rates of the control valves V1 to V5. Or, the required flow rate Q1 may be obtained by obtaining the flow rates of the control vales V1 to V5 based on the differential pressures ΔP of the control valves V1 to V5, and then totalizing the flow rates of the control valves V1 to V5. Further, the required flow rate Q1 may be obtained in other methods.

In addition, the revolving speed controller portion 55A obtains a required flow rate Q2 to be supplied to the hydraulic actuators (the traveling motor ML, the auxiliary actuator, and the turn motor MT) corresponding to the second block B2 (the left traveling control valve V6, the first SP control valve V7, the second SP control valve V8, the arm control valve, and the turn control valve V10). As in the required flow rate, the required flow rate Q2 may be obtained, for example, by calculating the respective opening apertures of the control valves V6 to V10 based on the operating extents of the work operating member and the travel operating member, obtaining the flow rates of the control valves V6 to V10 based on the relation between the respective opening apertures and values Cv (capacity coefficients) of the control valves V6 to V10, and then totalizing the flow rates of the control valves V6 to V10. Or, the required flow rate Q2 may be obtained by obtaining the flow rates of the control vales V6 to V10 based on the differential pressures ΔP of the control valves V6 to V10, and then totalizing the flow rates of the control valves V6 to V10. Further, the required flow rate Q2 may be obtained in other methods.

Next, the revolving speed controller portion 55A determines the target engine revolving speed (a required revolving speed) based on the required flow rates Q1 and Q2 and the swash plate angle of the hydraulic pump (the swash plate angle of the first hydraulic pump P1 and the swash plate angle of the second hydraulic pump P2). In particular, when the first output fluid tube 41 and the second output fluid tube 42 are in communication with each other through the communication valve V11, the revolving speed controller portion 55A determines the target engine revolving speed with the equation (1). In addition, when the communication between the first output fluid tube 41 and the second output fluid tube 42 are blocked by the communication valve V11, the revolving speed controller portion 55A determines the target engine revolving speed with the equation (2) and the equation (3).

(Expressions)

Target engine rev. speed(required rev. speed)=required flow rate $Q1$[cc/min]+required flow rate $Q2$[cc/min]/(swash plate angle of first hydraulic pump $P1$[cc/rev]+swash plate angle of second hydraulic pump $P2$[cc/rev]) Equation (1)

Target engine rev. speed(required rev. speed)=required flow rate $Q1$[cc/min]/(swash plate angle of first hydraulic pump $P1$[cc/rev]) Equation (2)

Target engine rev. speed(required rev. speed)=required flow rate $Q1$[cc/min]/(swash plate angle of second hydraulic pump $P1$[cc/rev]) Equation (3)

In determining the target engine revolving speed, the swash plate angles of the hydraulic pumps (the swash plate angle of the first hydraulic pump P1 and the swash plate angle of the second hydraulic pump P2) are employed. When the load applied to the hydraulic actuator becomes larger than a predetermined value, the swash plate angle becomes smaller than a predetermined angle of the hydraulic pump. When the load applied to the hydraulic actuator is reduced from the state where the load is maintained high (the state where the swash plate angle of the hydraulic pump is reduced due to the influence of the load), the swash plate angle of the hydraulic pump returns to the predetermined angle. Thus, in the above-described equations (1) to (3) of the target engine revolving speed, the target engine revolving speed can be changed in accordance with the swash plate angle of the hydraulic pump, and thus the target engine revolving speed can be changed base on the operation load. In equations (1) to (3), the swash plate angle may be the maximum value.

Then, when the first output fluid tube 41 and the second output fluid tube 42 are communicated with each other by the communication valve V11, the revolving speed controller portion 55A outputs the target engine revolving speed obtained in equation (1) to the control device 52. In addition, when the communication between the first output fluid tube 41 and the second output fluid tube 42 are blocked by the communication valve V11, the revolving speed controller portion 55A outputs, to the control device 52, the larger one of the target engine revolving speed determined in the equation (2) and the target engine revolving speed determined in the equation (3). The switching operation of the communication valve V11 is performed by the control device 51 on the basis of the working state or the traveling state of the working machine 1. The switching operation of the communication valve V11 may be performed by the switching of a switch or the like provided around the operator seat 6 or may be performed by other methods.

As described above, in the integrated control mode, the revolving speed controller portion 55A of the control device 51 changes the target engine revolving speed is changed in accordance with the work load, and thereby the actual engine revolving speed is increased or decreased in accordance with the load. In this manner, according to the integrated control mode, the engine revolving speed is increased or decreased in accordance with the work load, and thereby the work can be performed at the constant speed without decreasing the speed of the hydraulic actuator, while the energy saving is achieved.

In the integrated control mode, the target engine revolving speed is changed in accordance with the load. However, the control of the control valves V1 to V11 and the control of the swash plate angle of the hydraulic pump are similar to the controls in the standard control mode.

The working machine 1 is configured to limit the engine revolving speed for each hydraulic actuator (for each hydraulic attachment) or for each work performed by the working machine 1 or the working device 4 (for each working content). As shown in FIG. 3, the engine revolving speed is limited through the display device 70 connected to the control device 51.

The control device 51 has a first setting portion 56. The first setting portion 56 is constituted of an electronic/electric circuit, a computer program, or the like provided in the control device 51. The first setting portion 56 cooperates with the display device 70 to set a limit value (an upper limit value and/or a lower limit value of the engine revolving speed) of the engine revolving speed.

Figure 3A:
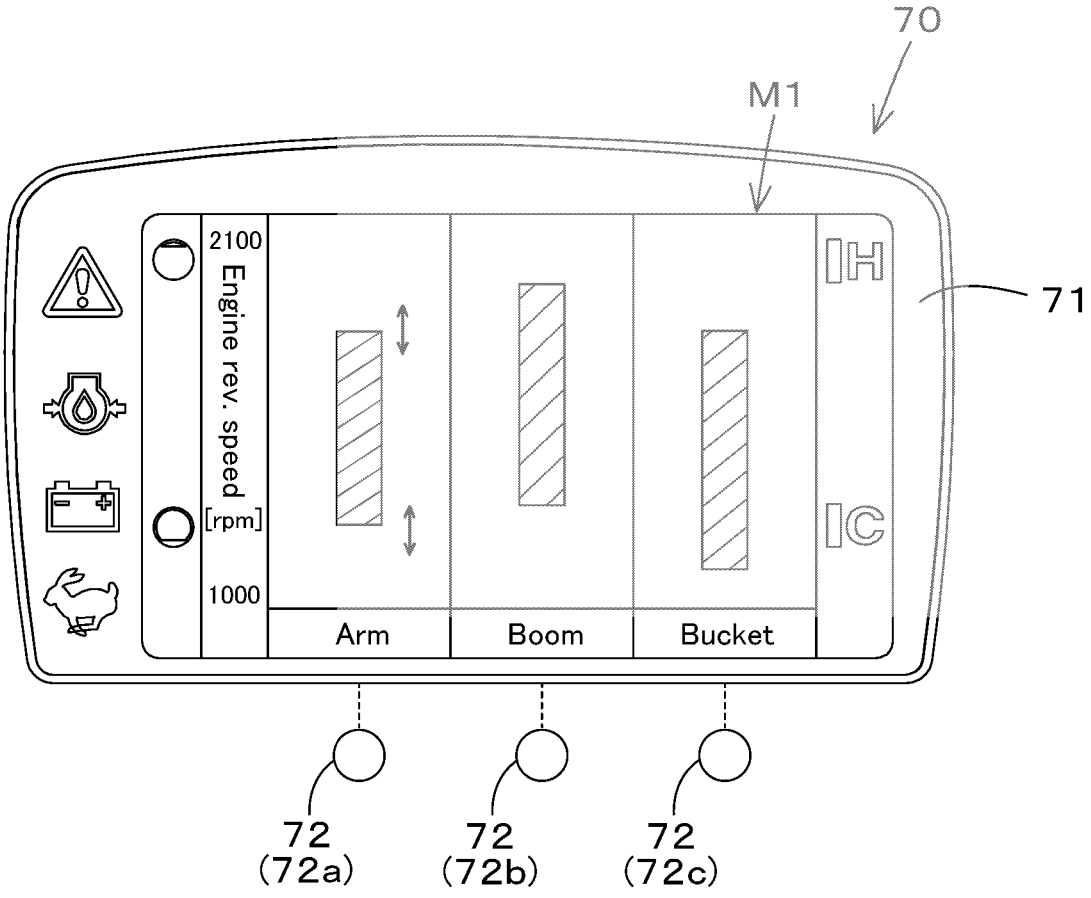
FIG. 3A is a view illustrating a setting screen for setting an engine revolving speed for each of hydraulic attachments according to the first embodiment.
Figure 3B:
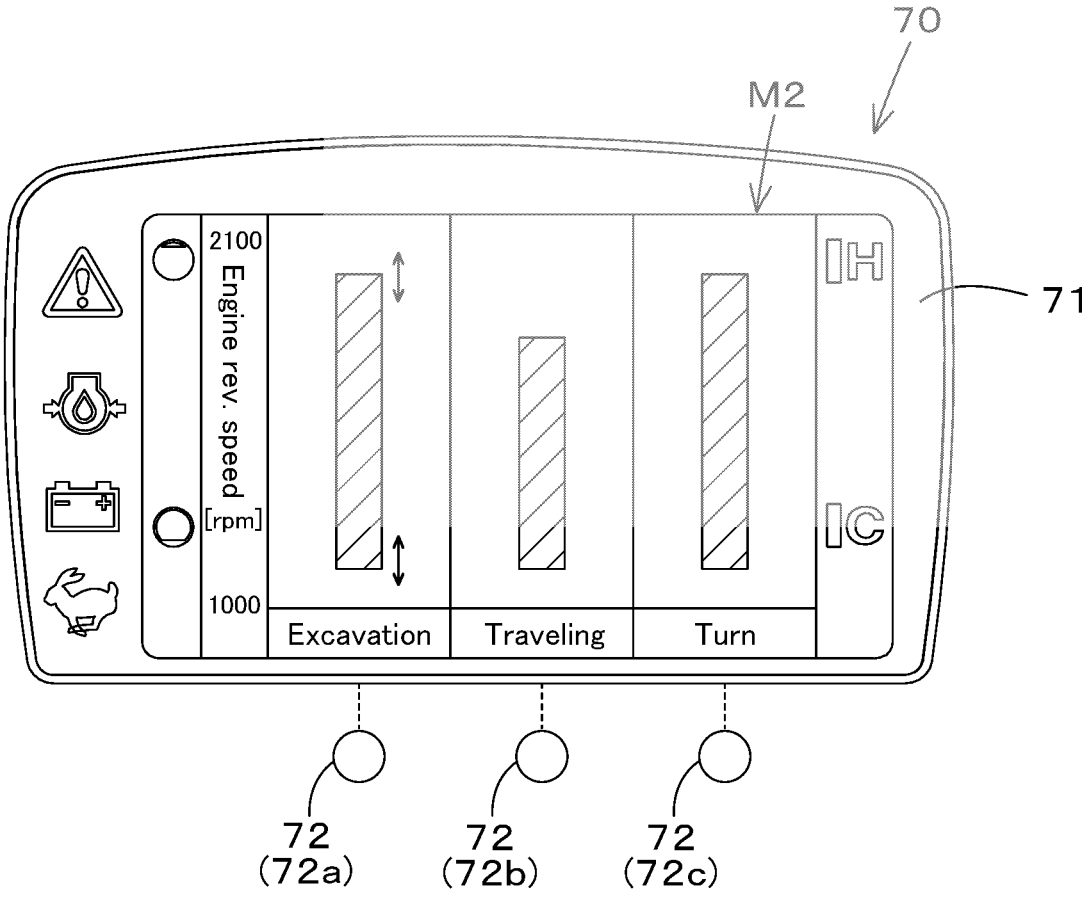
FIG. 3B is a view illustrating a setting screen for setting the engine revolving speed for each of operations according to the first embodiment.

As illustrated in FIG. 3A and FIG. 3B, the display device 70 includes a display portion 71 that is configured to display various information relating to the working machine 1, and an operating portion (an operation tool) 72 configured to operate the display portion 71 and the like. The display portion 71 is constituted of a panel such as a liquid crystal. The operating portion 72 is constituted of a plurality of switches or the like, and includes a first switch 72*a*, a second switch 72*b*, and a third switch 73*c*. The operating portion 72 may be anything as long as it can operate the display device 70, and is not limited to the switch.

As illustrated in FIG. 3A, the first setting portion 56 of the control device 51 displays a setting screen M1 on the display portion 71 of the display device 70 when a predetermined operation is performed in the operating portion 72. The setting screen M1 is a screen used to limit the engine revolving speed for each hydraulic actuator (each hydraulic attachment). The first setting portion 56 displays, on the setting screen M1, characters and figures indicating the hydraulic attachments (the boom, the bucket, the arm, and the like) that can be attached to the working machine 1. In addition, the first setting portion 56 displays, on the setting screen M1, the upper limit value and/or the lower limit value of the engine revolving speed corresponding to each hydraulic attachment with use of numeric numbers or figures (bars). When the operator selects the first switch 72*a* on the setting screen M1, the first setting portion 56 determines a hydraulic attachment among the plurality of hydraulic attachments displayed on the setting screen M1, which is a target for setting the engine revolving speed. When the operator selects, on the setting screen M1, the second switch 72*b* and the third switch 72*c* after determining the hydraulic attachment that is a target for setting the engine revolving speed, the first setting portion 56 increases and decreases the upper limit value and/or the lower limit value of the engine revolving speed corresponding to the hydraulic attachment. And, when the operator selects the first switch 72*a* again, the first setting portion 56 determines the upper limit value and/or the lower limit value of the engine revolving speed as the selected value.

In this manner, the first setting portion 56 of the control device 51 can set the limit value (the upper limit value and/or the lower limit value) of the engine revolving speed for each hydraulic attachment that can be attached to the working machine 1.

As illustrated in FIG. 3B, the first setting portion 56 of the control device 51 displays a setting screen M2 on the display portion 71 of the display device 70 when a predetermined operation is performed in the operating portion 72. The setting screen M2 is a screen used to limit the engine revolving speed for each working. The first setting portion 56 displays, on the setting screen M2, characters and figures indicating the working (the excavation, the traveling, the turn, and the like) that can be performed by the working machine 1. In addition, the first setting portion 56 displays, on the setting screen M2, the upper limit value and/or the lower limit value of the engine revolving speed corresponding to each working with use of numeric numbers or figures (bars). When the operator selects the first switch 72*a* on the setting screen M2, the first setting portion 56 determines the working among the plurality of workings displayed on the setting screen M2, which is a target for setting the engine revolving speed. When the operator selects, on the setting screen M2, the second switch 72*b* and the third switch 72*c* after determining the working that is a target for setting the engine revolving speed, the first setting portion 56 increases and decreases the upper limit value and/or the lower limit value of the engine revolving speed corresponding to the working. And, when the operator selects the first switch 72*a* again, the first setting portion 56 determines the upper limit value and/or the lower limit value of the engine revolving speed as the selected value.

In this manner, the first setting portion 56 of the control device 51 can set the limit value (the upper limit value and/or the lower limit value) of the engine revolving speed for each working that can be performed by the working machine 1. In the above-described embodiment, the control device 51 (the first setting portion 56) controls the display on the display device 70. However, the control device 51 (the first setting portion 56) may be provided on the display device 70. And, the display device 70 and the control device 51 (the first setting portion 56) may be integrated.

In the embodiment described above, the limit value of the engine revolving speed can be arbitrarily set for each hydraulic actuator (the hydraulic attachment). However, the limit values of at least two hydraulic actuators (the hydraulic attachments) may be respectively set to different values for each hydraulic actuator (the hydraulic attachment).

Figure 3C:
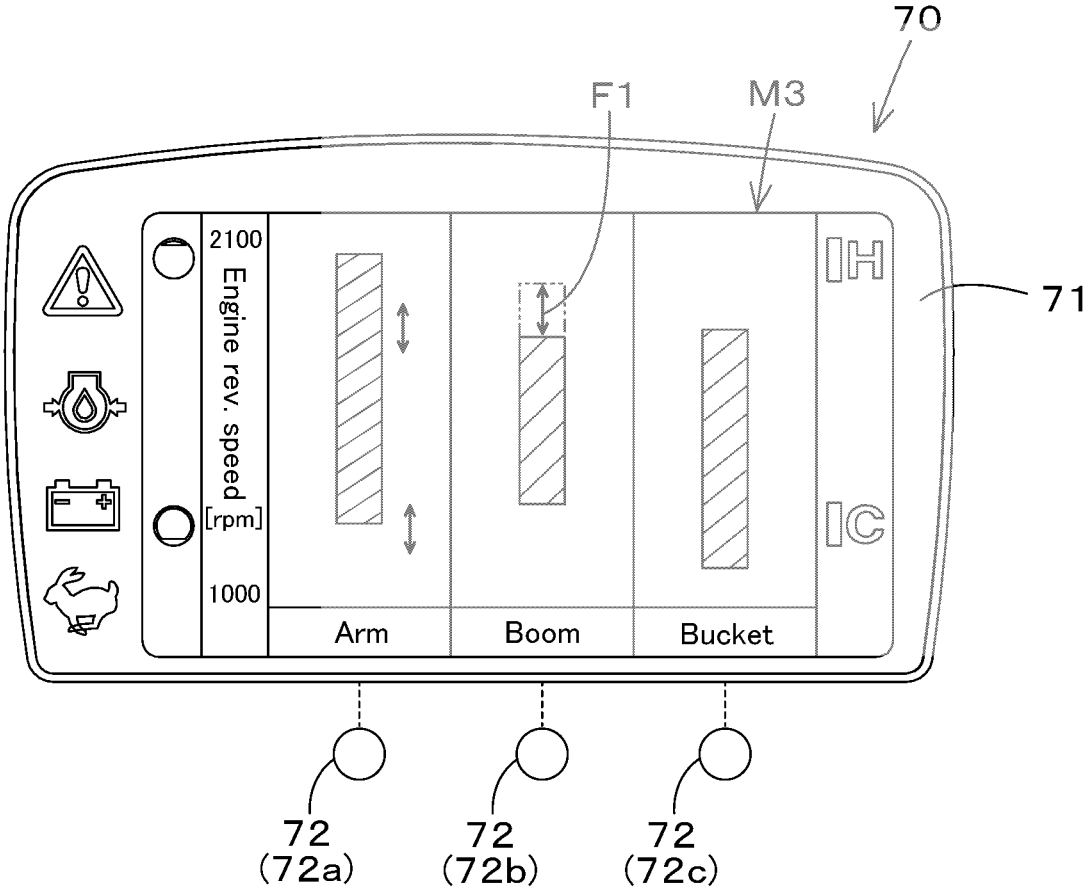
FIG. 3C is a view illustrating a setting screen for changing the engine revolving speed of the hydraulic attachment to a different value according to the first embodiment.

FIG. 3C shows a setting screen M3 in which the limit values can be respectively set to different values. The setting screen M3 displays characters and figures indicating the hydraulic attachments (the boom, the bucket, the arm, and the like) that can be attached to the working machine 1 as in the setting screen M1 described above. As shown in FIG. 3C, for example, the first setting portion 56 displays, on the setting screen M3, a setting allowable range (a range in which the limit value can be set) F1 for the engine revolving speed for another hydraulic attachment such as the boom after setting the engine revolving speed of the arm. The setting allowable range F1 is changed depending on the engine revolving speed of the hydraulic attachment set in advance, such as the arm.

Accordingly, the operator operates the second switch 72*b* and the third switch 72*c* to determine the set value of the engine revolving speed for the boom within the setting allowable range F1, thereby setting the limit value different from the engine revolving speed for the arm. Note that the setting screen M3 in FIG. 3C is an example in which the limit values are respectively set to different values according to at least two hydraulic attachments, that is, an example in which the engine revolving speed set in advance varies the setting allowable range F1 of the engine revolving speed to be set later. The hydraulic attachment and the exemplified engine revolving speed exemplified above are not limited to those shown in FIG. 3C.

Or the first setting portion 56 may set the set value of each hydraulic attachment so that the set value of a predetermined hydraulic attachment of the hydraulic attachments may not exceed the set value of another hydraulic attachment. For example, when the set value for the arm is set to be high among the arm, the boom, and the bucket, the first setting portion 56 sets the upper limit of the set values of the boom and bucket to be lower than the set value for the arm.

Figure 4:
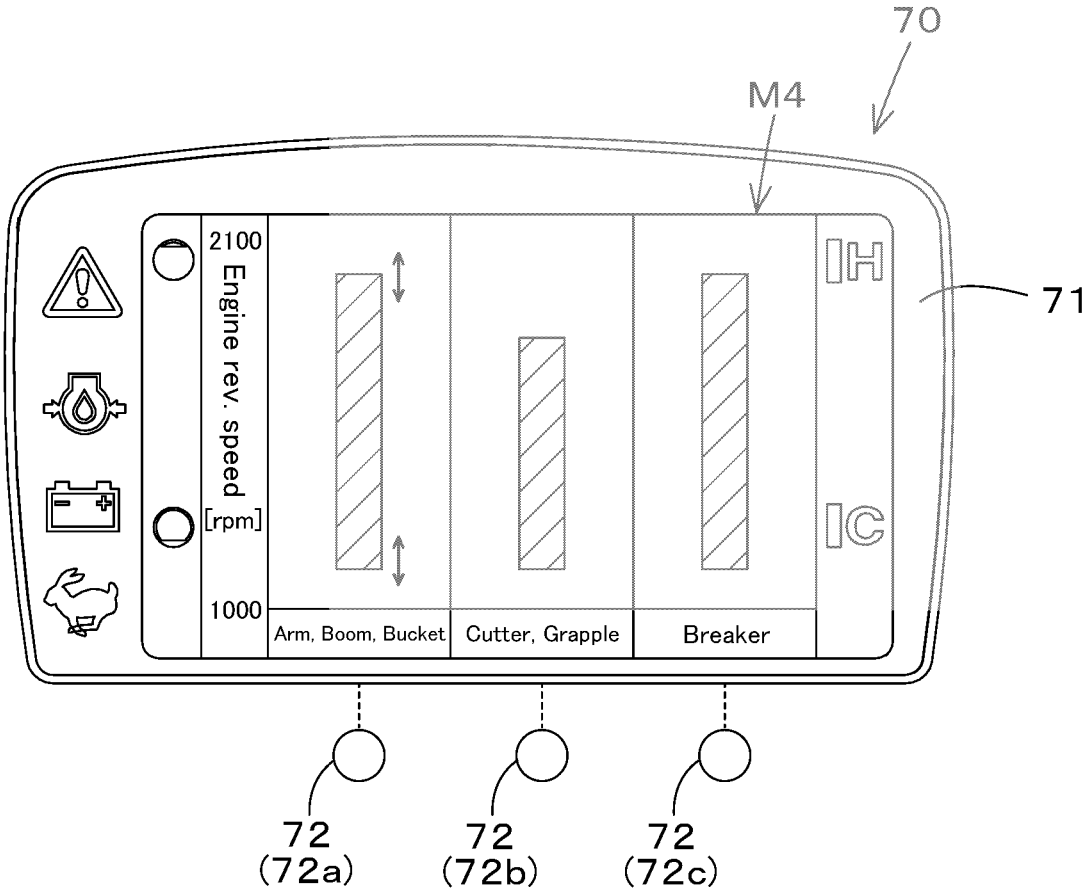
FIG. 4 is a view illustrating a setting screen for setting the engine revolving speed for each of groups according to the first embodiment.

In the above-described embodiment, the limit value of the engine revolving speed can be set for each hydraulic actuator (the hydraulic attachment) or for each working. However, the hydraulic actuators or the workings may be grouped, and then the limit values may be set for each group. As shown in FIG. 4, the first setting portion 56 displays a setting screen M4 of the display portion 71 of the display device 70. In the setting screen M4, for example, a first group of the arms, the booms, and the buckets, a second group of the cutters and the grapples, and a third group of the breakers are displayed. The first setting portion 56 sets an upper limit value and/or a lower limit value of the engine revolving speed for each group (the first group, the second group, and the third group) displayed on the setting screen M4. Note that it is preferable to set the group arbitrarily by operating the display device 70.

In the embodiment described above, different limit values are set for each hydraulic actuators (each hydraulic attachments) for at least two hydraulic actuators (the hydraulic attachments). However, instead of that, different limit values may be set to each working for at least two workings. For example, when the limit value for the excavation working is 2100 rpm, the limit value for the traveling working is set to 1600 rpm. In addition, the numerical value of the limit value mentioned above is just an example, and is not limited thereto.

In the integrated control mode, the engine revolving speed is limited so as not to exceed the limit values (the upper limit value, the lower limit value) set by the first setting portion 56. The control device 51 includes a revolving speed limiter portion 58 that limits the engine revolving speed to the limit value set by the first setting portion 56. The revolving speed limiter portion 58 is constituted of an electronic/electric circuit, a computer program, or the like provided in the control device 51.

The revolving speed limiter portion 58 does not limit the engine revolving speed when the required revolving speed calculated by the revolving speed controller portion 55A is equal to or less than the set value (the upper limit value). In other words, the revolving speed limiter portion 58 allows the engine revolving speed to be increased or decreased in accordance with the required revolving speed obtained by the revolving speed controller portion 55A. On the other hand, the revolving speed limiter portion 58 limits the engine revolving speed when the required revolving speed calculated by the revolving speed controller portion 55A exceeds the set value (the upper limit value).

For example, the revolving speed limiter portion 58 does not limit the engine revolving speed when the set value of the arm 16 is 1800 rpm under a state where the required revolving speed is 1600 rpm in operating the arm 16. However, the revolving speed limiter portion 58 limits the engine revolving speed when the set value of the arm 16 is 1400 rpm. That is, when the required revolving speed is smaller than the set value, the revolving speed limiter portion 58 limits, to the set value, the target engine revolving speed (the output revolving speed) to be outputted to the control device 52.

As described above, even when the control device 51 is in the integrated control mode by the revolving speed limiter portion 58, the control device 51 has the revolving speed limiter portion 58. Noise can be reduced by restriction of the engine revolving speed with the fuel consumption improved. In addition, as described above, the engine revolving speed can be flexibly changed in accordance with the working while the operator sets the engine revolving speed required for the working.

The control device 51 sets the target engine revolving speed based on the command value of the accelerator setting member 64 in the standard control mode. However, the control device 51 sets not the target engine revolving speed but another parameter relating to the working machine 1 based on the ordered value of the accelerator setting member 64 in the integrated control mode. That is, the accelerator setting member 64 is used to set a target engine revolving speed in the standard control mode, but is used to set another parameter different from the target engine revolving speed in the integrated control mode.

In particular, the control device 51 includes a second setting portion 59 that determines a command value set by the accelerator setting member 64. The second setting portion 59 is constituted of an electronic/electric circuit, a computer program, or the like provided in the control device 51. When the command value determined by the accelerator setting member 64 is input to the control device 51 in the standard control mode, the second setting portion 59 sets the target engine revolving speed based on the command value inputted. In other words, in the standard control mode, when the command value is changed by operating the accelerator setting member 64, the second setting portion 59 can change the target engine revolving speed from the idling speed to the maximum speed.

On the other hand, in the integrated control mode, that is, in increasing or decreasing the engine revolving speed according to the load, the second setting portion 59 sets an operation fluid change value for increasing or decreasing the operation fluid flow rate based on the inputted command value when the command value determined by the accelerator setting member 64 is input to the control device 51. And the control device 51 increases/decreases the swash plate angle of the hydraulic pump (the first hydraulic pump P1, the second hydraulic pump P2) from the current swash plate angle according to the operation fluid change value. For example, when the command value is changed by operating the accelerator setting member 64 in the integrated control mode, the second setting portion 59 causes the swash plate angle of the hydraulic pumps (the first hydraulic pump P1, the second hydraulic pump P2) to be increased or decreased within a range of ±10%. That is, in the integrated control mode, the revolving controller portion 55A automatically increases or decreases the engine revolving speed, so the accelerator setting member 64 for increasing or decreasing the engine revolving speed is not required. However, the accelerator setting member 64 that is no longer required by the integrated control mode can be used as another setting member for adjusting the operation fluid. In this manner, even in the integrated control mode, the swash plate angle of the hydraulic pump can be changed, so that the speed of the hydraulic actuator can be finely adjusted. In the above-described embodiment, the accelerator setting member 64 is changed to the setting member for increasing/decreasing the operation fluid by the second setting portion 59. However, the setting manner is not limited to that configuration, and any component may be employed as the setting member for setting the working machine 1.

Second Embodiment

Figure 5:
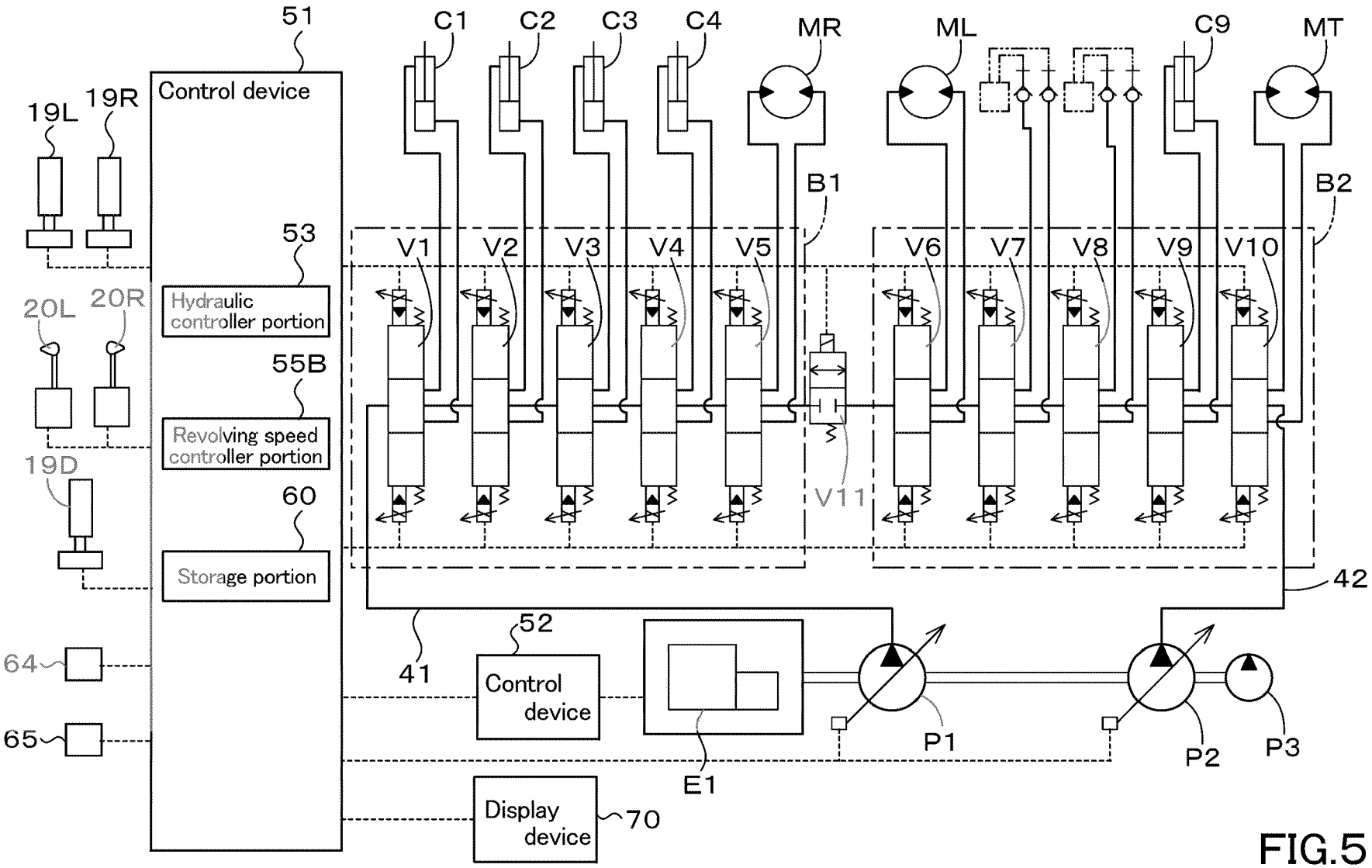
FIG. 5 is a schematic configuration view illustrating a hydraulic system and a control system of a working machine according to a second embodiment of the present invention.

FIG. 5 shows the hydraulic system and the control system according to a second embodiment of the present invention. In addition, explanations of the configurations similar to the configuration of the first embodiment will be omitted.

As shown in FIG. 5, the control device 51 includes a hydraulic controller portion 53, a revolving controller portion 55B, and a storage portion 60. The hydraulic controller portion 53 and the revolving controller portion 55B are constituted of an electronic/electric circuit, a computer program, or the like provided in the control device 51. The hydraulic controller portion 53 controls, for example, a plurality of control valves V1 to V11, a hydraulic pump, and the like, as in the above-described embodiment. The revolving controller portion 55B sets the engine revolving speed based on the operating extents of the operation members (the work operating member, the travel operating member). That is, the revolving speed controller portion 55B increases or decreases the revolving speed of the engine based on the operating extents of the operation members before the hydraulic controller portion 53 controls the hydraulic pump.

Figure 6:
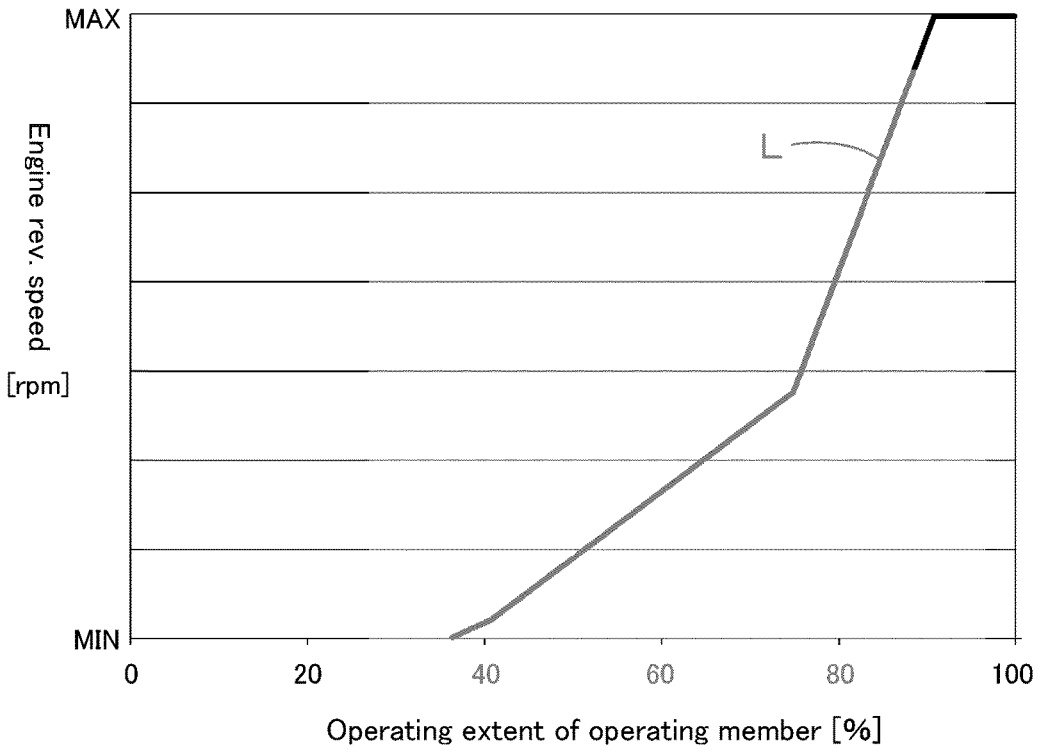
FIG. 6 is a view illustrating a relation between an engine revolving speed and an operating extent of an operating member according to the second embodiment.

FIG. 6 shows an example of a control line L indicating the relation between the engine revolving speed and the operating extent of the work operating member used for setting the engine revolving speed by the revolving controller portion 55B. First, the control line L will be described. The relation (the control line L) between the engine revolving speed and the operating extent of the work operating member is stored in the storage portion 60 of the control device 51. The relation between the engine revolving speed and the operating extent of the work operating member may be data in which a value indicating the operating extent of the work operating member is associated with a value indicating the engine revolving speed, may be a function for obtaining the engine revolving speed from the above, or may be any methods that relates the operating extent and the engine revolving speed.

As shown in FIG. 6, the control line L indicates that the engine revolving speed is the idling speed (the minimum speed) when the operating extent is 0 to less than 38%, the engine revolving speed is increased as the operating extent increases exceeding 38%, and the engine revolving speed becomes the maximum when the operating extent exceeds approximately 80%. The control line L is obtained by obtaining the required flow rate Q3 from the operating extent of the operation member and then converting the required flow rate Q3 into the engine revolving speed. That is, the control line L1 sets the engine revolving speed based on the flow rate (the required flow rate) of operation fluid corresponding to the operating extent of the work operating member. The control line L1 sets the engine revolving speed based on the swash plate angle of the hydraulic pump. In other words, the revolving controller portion 55B sets the engine revolving speed based on the flow rate (the required flow rate) of the operation fluid corresponding to the operating extent of the work operating member, and sets the engine revolving speed based on the swash plate angle of the hydraulic pump. In addition, the calculation method of the control line L is an example, and is not limited thereto.

The control line L is assigned to each of the operation directions (the front, the rear, the right, the left) of the work operating member 19L, the work operating member 19R, and the work operating member 19D. In other words, the control line L is assigned to each working in the working machine 1. For example, since the operation member 19L, the operation member 19R, and the operation member 19D are operated in ten directions (there are ten types of operations), ten control lines L1 corresponding to the ten directions are stored in the storage portion 60. In the control valves V1 to V10, when the flow characteristics are the same, the control line L having the same flow characteristics may be shared.

Figure 7:
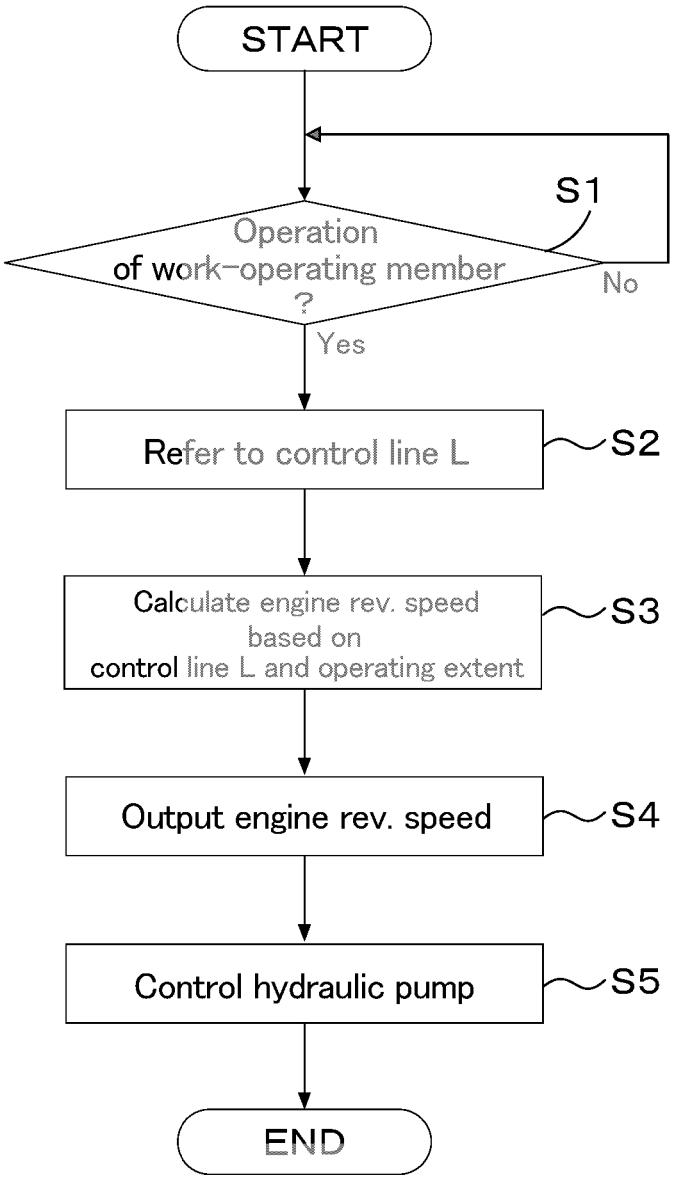
FIG. 7 is a view illustrating a first control flowchart according to the second embodiment.

FIG. 7 shows a first control flowchart according to the second embodiment. As shown in FIG. 7, when the operation of the work operating member is performed (step S1, Yes), the revolving controller portion 55B, based on the operation direction and the operating extent of the work operating member, refers to a predetermined control line L stored in the storage portion 60 (step S2), and calculates the engine revolving speed from the referenced control line L and the operating extent (step S3). The calculated engine revolving speed is outputted to the control device 52 (step S4). For example, when the work operating member is operated in the direction in which the arm is raised, the revolving controller portion 55B refers to the control line L corresponding to the operation direction of the work operating member that operates the arm, the engine revolving speed (the target engine revolving speed) is obtained from the control line L and the operation amount of the work operating member, and the engine revolving speed (the target engine revolving speed) is output to the control device 52. At substantially the same time as outputting the engine revolving speed (the target engine revolving speed) to the control device 52, the control device 51 (the revolving controller portion 55B) outputs a control signal corresponding to the operating extent of the work operating member to the solenoid valves of the control valves V1 to V1, and thereby the control valves V1 to V10 are controlled to maximize the swash plate angle of the hydraulic pump.

After the engine revolving speed is controlled by the revolving controller portion 55B according to the operating extent of the work operating member (after the engine revolving speed is set by the revolving speed controller portion 55B), the hydraulic controller portion 53 executes the control to the hydraulic pump (step S5). For example, the hydraulic controller portion 53 controls the opening apertures of the solenoid valves of the control valves V1 to V10 according to the operating extent and the operation direction of the work operating member, and controls the angle of the swash plate of the hydraulic pump according to the operating extent and the like.

According to the above configuration, when the work operating member is operated from the neutral position, the output required for the operation of the hydraulic actuator can be quickly obtained by increasing the engine revolving speed according to the operating extent of the work operating member. That is, the responsiveness to the operation of the operation member can be improved. In the above-described embodiment, the engine revolving speed is obtained based on the operating extent of the work operating member. However, the engine revolving speed may be obtained based on the operating extent of the travel operating member. That is, the control line L1 may be applied to the travel operating member or may be applied to the traveling state.

Figure 8:
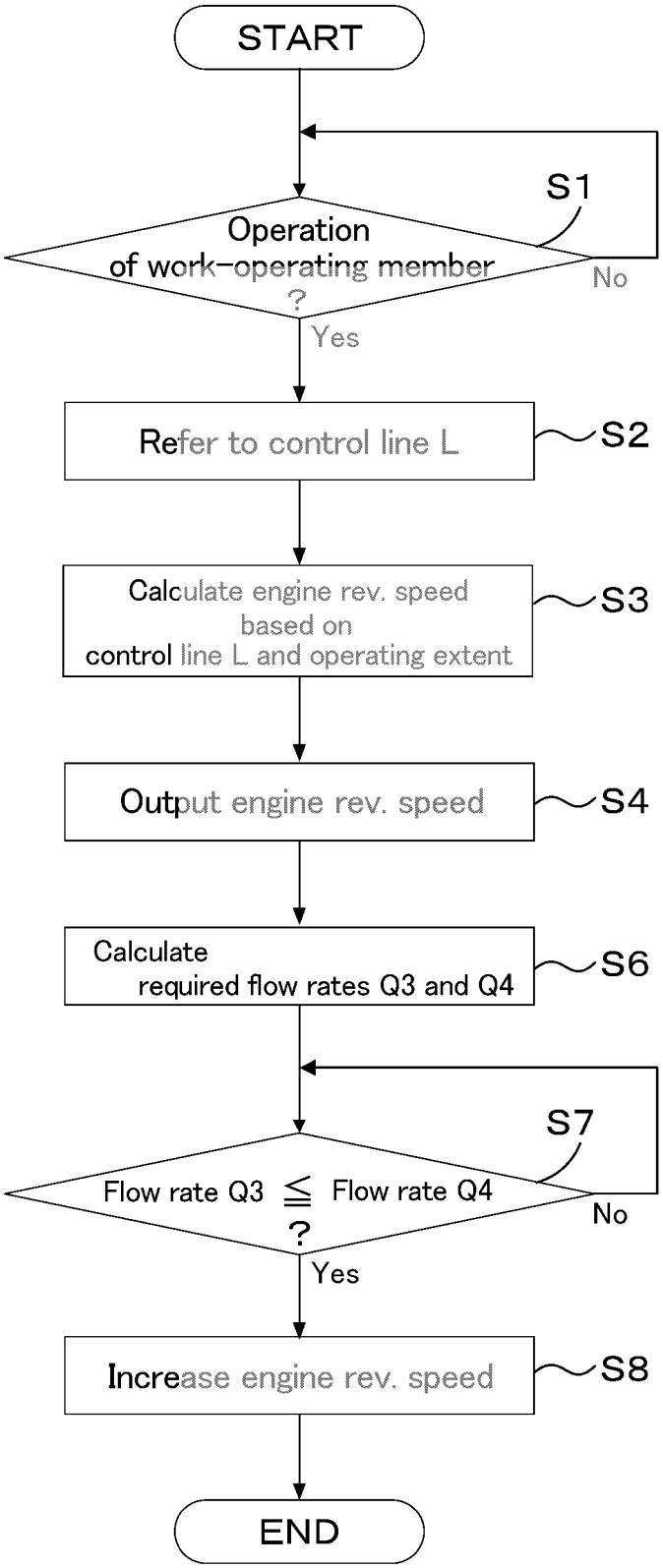
FIG. 8 is a view illustrating a second control flowchart according to the second embodiment.

FIG. 8 shows a second control flowchart according to the second embodiment. In FIG. 8, step S1 to step S4 are the same as the steps in FIG. 7 except that the steps is for the operation members.

As shown in FIG. 8, after the output of the engine revolving speed in the revolving controller portion 55B (after step S4), a required flow rate (an expected flow rate) Q4 corresponding to the hydraulic controller portion 53 is calculated, and a required flow rate (an expected flow rate) Q3 corresponding to the revolving speed controller portion 55B is calculated (step S6). For example, the hydraulic controller portion 53 calculates the respective opening apertures of the control valves V1 to V10 based on the operating extents of the work operating member and the travel operating member, obtains the respective flow rates of the control valves V1 to V10 based on the relation between the values Cv and the respective opening apertures of the control valves V1 to V10, and obtains the required flow rate Q4 by totalizing the flow rates of the control valves V1 to V10, or may obtain the flow rates of the control valves V1 to V10 based on the differential pressures ΔP or the like of the control valves V1 to V10, and may obtain the required flow rate Q4 by totalizing the flow rates of the control valves V1 to V10. Or, the required flow rate Q4 may be obtained in other methods.

Next, the required flow rate Q4 calculated by the hydraulic pressure controller portion 53 is compared with the required flow rate Q3 calculated by the revolving speed controller portion 55B (step S7). When the required flow rate Q3 is equal to or less than the required flow rate Q4 (step S7, Yes), the hydraulic pressure controller portion 53 determines that the flow rate of operation fluid cannot be obtained from the engine revolving speed set by the revolving speed controller portion 55B (step S8). For example, the hydraulic controller portion 53 increases the engine revolving speed until the required flow rate Q4 becomes equal to or higher than the value converted into the engine revolving speed using the equation (2), the equation (3), or the like.

In FIG. 8, the required flow rate Q4 and the required flow rate Q3 are compared. Instead of that configuration, the hydraulic controller portion 53 converts the required flow rate Q4 into the engine revolving speed, the revolving speed controller portion 55B converts the required flow rate Q3 into the engine revolving speed, and then the converted engine revolving speeds may be compared with each other.

Japanese Patent No. 4732126 discloses a working machine including: an operating means for operating a plurality of hydraulic actuators; a target flow rate calculating means for calculating a target flow rate of the hydraulic pump from an operating extent of the operating means; a first engine revolving speed calculating means for calculating the first target revolving speed of the engine based on the target flow rate; and a second target revolving speed setting means for setting the target revolving speed of the engine to a second target revolving speed higher than the low idle revolving speed. The working machine is disclosed in Japanese Patent No. 4732126 includes a maximum value selecting means for selecting higher one of the first target revolving speed and the second target revolving speed, a revolving speed controlling means for controlling the engine revolving speed so that the revolving speed matches the target revolving speed selected by the maximum value selection means when it is determined that the operating state is established; and a pump absorption torque control means for controlling the hydraulic pump so that the pump absorption torque corresponding to the target revolving speed selected by the maximum value selection means.

However, the working machine disclosed in Japanese Patent No. 4732126 calculates the target flow rate of the hydraulic pump based on the operating extent of the operation means, and then sets the target engine revolving speed according to the target flow rate of the hydraulic pump. In this manner, the hydraulic pump is controlled so that the pump absorption torque corresponding to the target revolving speed can be obtained. Thus, there is a problem to deteriorate the response (responsiveness) from when the operation is started by the operation means until the output of the hydraulic pump is obtained.

On the other hand, in the above-described embodiment, the responsiveness to the operation of the operation member can be improved.

That is, after the engine revolving speed is increased by the revolving speed controller portion 55B, it is possible to shift to the control of the hydraulic controller portion 53 only when a sufficient output cannot be obtained in the engine revolving speed. Also in the second embodiment, the revolving controller portion 55A shown in the first embodiment may be employed so that not only the standard control mode but also the integrated control mode can be performed. The engine revolving speed may be set for each hydraulic actuator or for each work through the display device 70. That is, the hydraulic system for the working machine which is arbitrarily constituted of the combination of the second embodiment and the first embodiment may be configured.

Third Embodiment

Figure 9:
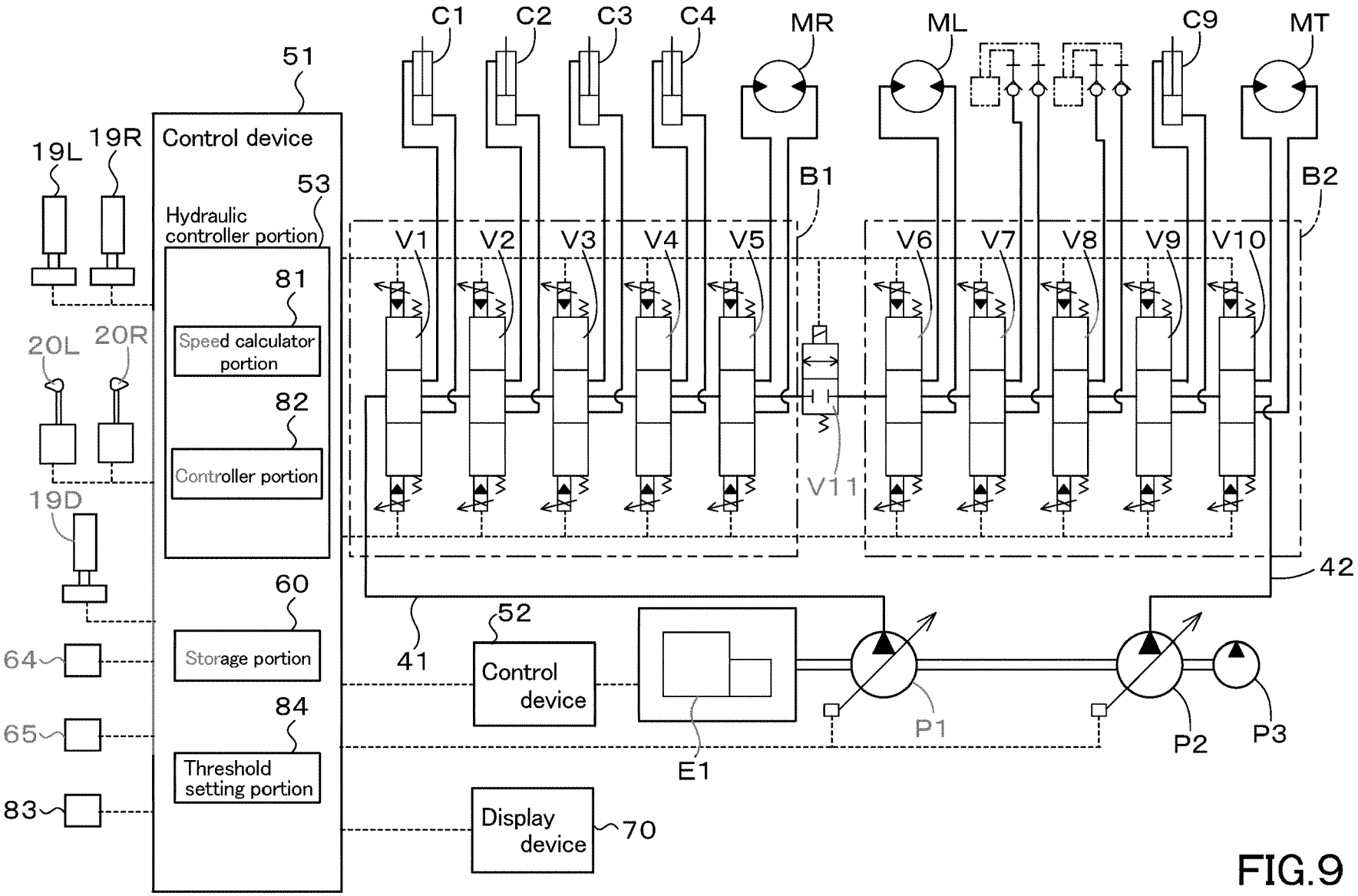
FIG. 9 is a schematic configuration view illustrating a hydraulic system and a control system of a working machine according to a third embodiment of the present invention.

FIG. 9 shows a hydraulic system and a control system according to a third embodiment of the present invention. In addition, description is omitted about the structure similar to the first embodiment or the second embodiment. In the third embodiment, when the hydraulic controller portion 53 of the control device 51 outputs a control signal (hereinafter, "a control value) to the solenoid valves of the control valves V1 to V10 based on the operating extent of the operation member, the control value is increased when a change in the operating extent of the operation member is fast, that is, when the operation speed is high. Hereinafter, the hydraulic controller portion 53 will be described in detail.

The control device 51 includes the hydraulic controller portion 53, the storage portion 60, and a threshold setting portion 84. The hydraulic controller portion 53 includes a speed calculator portion 81 and a controller portion 82. The speed calculator portion 81 and the controller portion 82 are constituted of an electronic electric circuit, a computer program, or the like provided in the control device 51. The speed calculator portion 81 calculates the operation speed of the operation member based on the swinging amount (the operating extent) detected by the potentiometer (the detector device) when the operation member is operated. In other words, the speed calculator portion 81 is a speed detector portion that detects the operation speed of the operation member.

The controller portion 82 controls the control valves V1 to V10 with the first control value corresponding to the operating extent of the operation member when the operation speed is less than the threshold SL, and when the operation speed is greater than or equal to the threshold SL, the control is performed with a second control value in which the opening apertures of the control valves V1 to V10 is larger than those of the one control value. That is, in the present embodiment, the first control value and the second control value each indicating the operating extent of the operation member and the current value supplied to the control valves V1 to V10 corresponding to the hydraulic actuators are stored in association with each other in the storage portion 60 in advance for the operation member corresponding to each hydraulic actuator is stored.

Figure 11A:
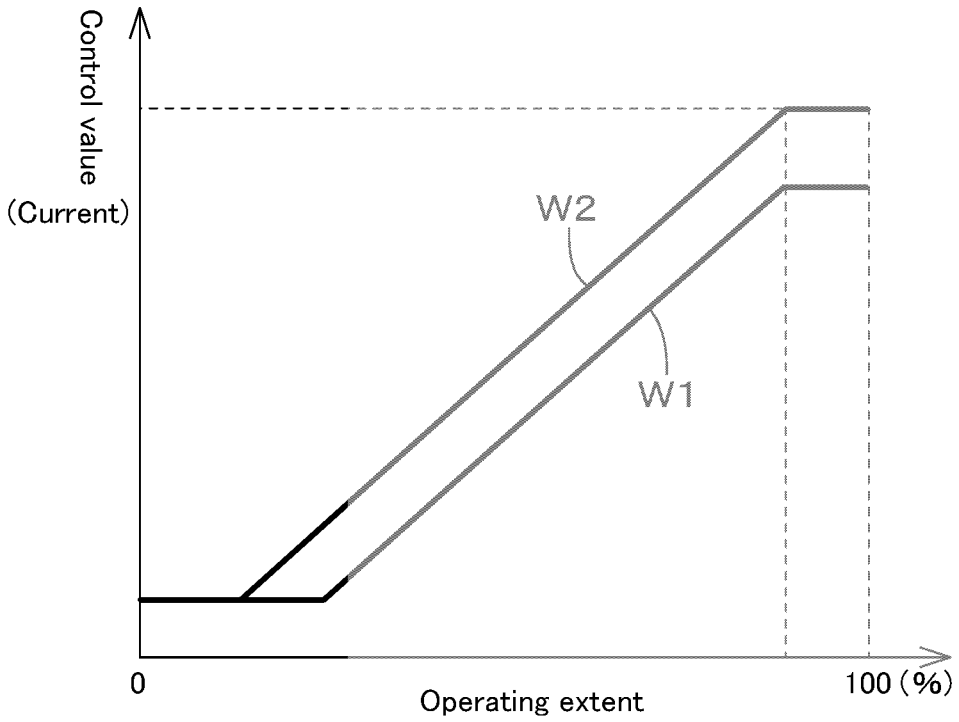
FIG. 11A is a view illustrating a relation between an operating extent of an operation member, a first control value, and a second control value according to the third embodiment.

FIG. 11A is a view illustrating an example of the relation between the operating extent of the operation member stored in the storage portion 60, the first control value W1, and the second control value W2. As shown in FIG. 11A, the first control value W1 and the second control value W2 increase as the operating extent of the operation member increases. The second control value W2 is larger than the first control value W1 at the same operating extent, and the second control value W2 is larger than the first control value W1. In addition, since the hydraulic controller portion 53 changes the opening aperture by excitation of the solenoid of the solenoid valve, the first control value and the second control value are current values. The first control value and the second control value may be voltage values.

Figure 10:
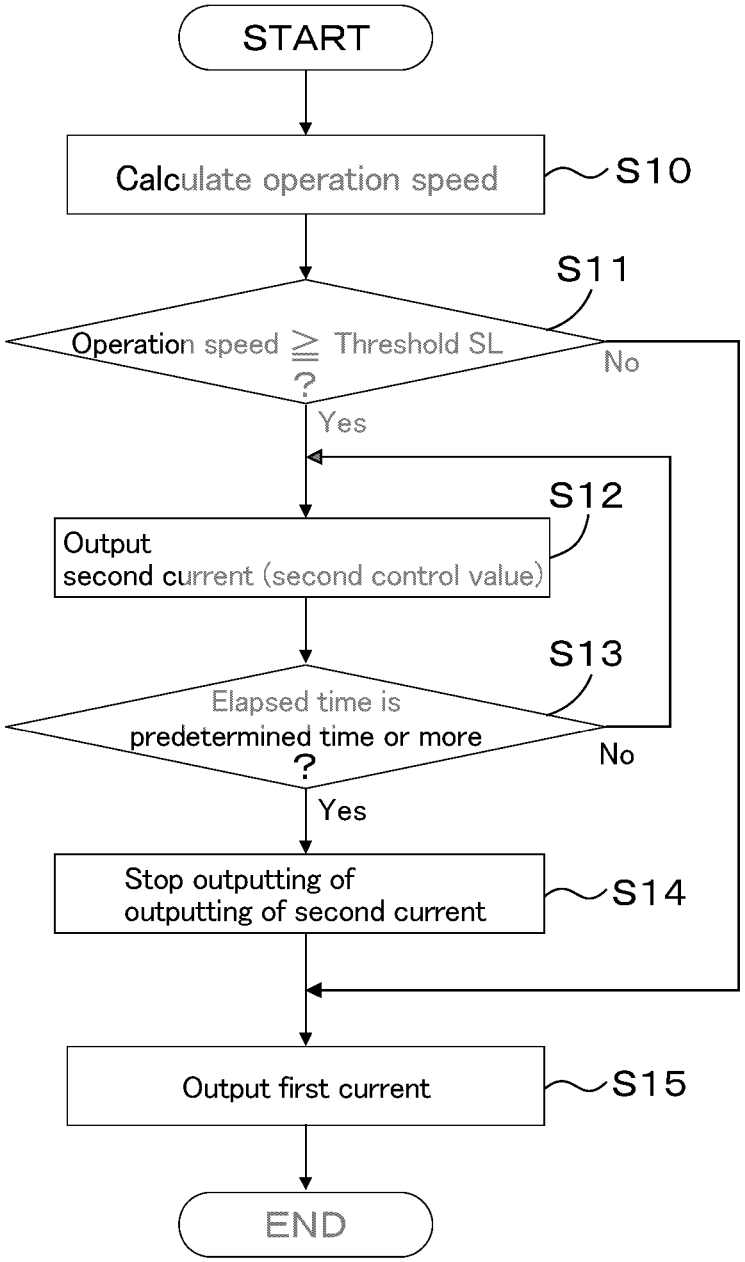
FIG. 10 is a view illustrating a first control flowchart used for controlling a control valve according to the third embodiment.
Figure 11B:
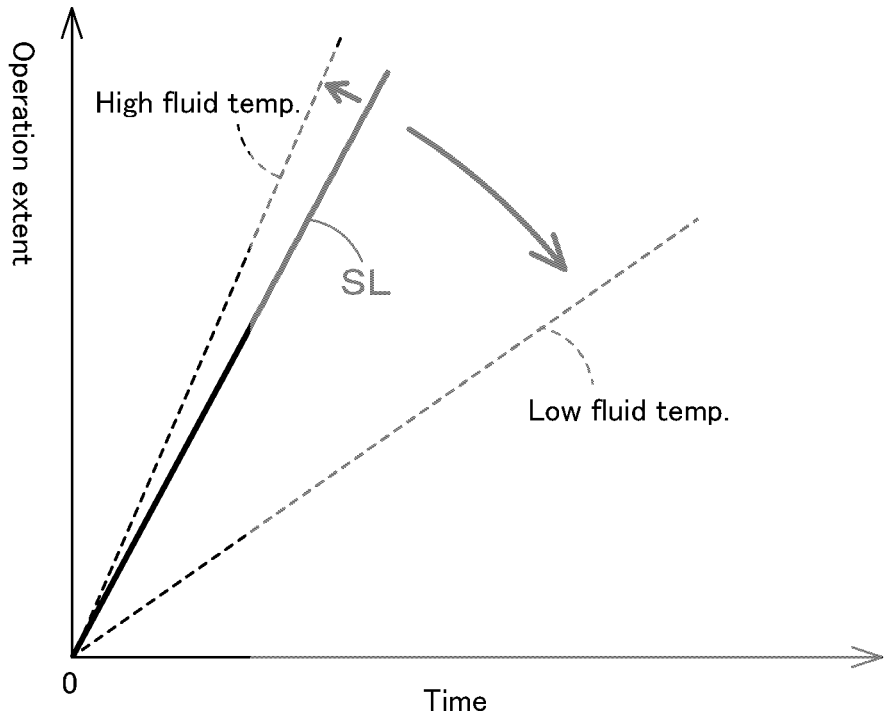
FIG. 11B is a view illustrating a relation between a threshold value, the operating extent, and time from the start of operation of the operating member according to the third embodiment.

FIG. 10 shows a first control flowchart of the control valves V1 to V10, and FIG. 11B shows the relation between the threshold SL, the operating extent, and the time from the start of operation of the operation member.

As shown in FIG. 10, when the operation member is operated, the speed calculator portion 81 calculates the operation speed (the change of the operating extent per predetermined time) based on the operation signal (the operating extent) inputted from the operation member to the control device 51 (step S10). In particular, in this embodiment, the operation position (or an operation angle) of the operation member is sampled every predetermined time (for example, every 0.5 msec), and the operation speed is calculated based on the sampling result for the predetermined time. The operation speed detection method is not particularly limited thereto, and other methods may be employed.

The controller portion 82 judges whether or not the operation speed is equal to or higher than the predetermined threshold SL (step S11), and when the operation speed is equal to or higher than the threshold SL (step S11, Yes), the second current (~one-shot current) corresponding to the second control value whose opening aperture is larger than that of the first current according to the first control value corresponding to the operating extent of the operation member is outputted to the solenoid valves of the control valves V1 to V10 (step S12). As shown in FIG. 11B, the threshold value SL is a value for judging whether or not the operator has operated the operating member quickly, and is set to several tens of milliseconds, for example. The first control value is a value indicating a current value (a first current value) set corresponding to the operating extent of the operation member, and is a value set based on the relation between the operating extent of the operation member and the opening apertures of the control valves V1 to V10. The second control value is a value indicating the second current value at which the opening apertures of the control valves V1 to V10 becomes larger than those in the first current value, and is a value set to quickly operate the control valves V1 to V10 (the solenoid valves).

The controller portion 82 judges whether or not the elapsed time after the outputting of the second current is equal to or greater than a predetermined value (step S13), stops the outputting of the second current (step S14) when the elapsed time is equal to or greater than the predetermined value (step S13, Yes), and then outputs the first current (step S15). The time (the elapsed time) for outputting the second current is, for example, several ms to 20 ms. The elapsed time is not limited to the numerical values described above.

On the other hand, when the operation speed is less than the predetermined threshold SL (step S11, No), the controller portion 82 outputs the first current instead of the second current (step S15).

Japanese Patent No. 2695335 discloses a working machine including: a control valve that controls a hydraulic actuator; and a control device that supplies an electric current according to an operating extent of an operation lever to set an opening aperture of the control valve. At the start of operation from the neutral position of the control lever, the control device supplies an electric current (a one-shot current) larger than the target current corresponding to the operating extent of the control lever to the control valve for a short time, and then reduces the current supplied to the valve to the target current.

However, in Japanese Patent No. 2695335, the one-shot current is supplied to the control valve at the start of operation regardless of the operating extent of the operation lever. That is, the one-shot current is supplied to the control valve even when the operating extent of the operation lever is small. For this reason, the hydraulic actuator may react more sensitively than the operator intended.

On the other hand, in the above-described embodiment, the operation speed of the hydraulic actuator can be appropriately controlled according to the operation speed of the operation member by the operator. In particular, the hydraulic actuator can be quickly moved according to the steep operation speed of the operation member only when the operator steeply operates the operation member at the operation speed equal to or higher than the threshold SL, and the hydraulic actuator can be operated slowly according to the operation speed of the operation member when the operator moves slowly the operation member at the operation speed below the threshold SL. For example, when the soil shoveled in the bucket 17 is dropped downward, the bucket 17 needs to move quickly. In that case, the bucket 17 can be quickly dumped by quickly operating the operation member that operates the bucket 17.

Further, when the operation speed of the operation member is slow, the hydraulic actuator operates slowly, so that both a steep movement and a slow movement can be achieved. Thus, the working machine 1 can reduce the noise and the fuel consumption as a whole.

Note that the threshold value SL described above may be arbitrarily set by the operator or the manager of the working machine 1 with use of the first setting portion 56 and the display device 70 described above. Further, the threshold value SL may be changed in accordance with conditions set in advance by the control device 51 (for example, the fluid temperature or an environmental temperature).

As shown in FIG. 9, a measurement device 83 that detects the temperature of the operation fluid is connected to the control device 51. Moreover, the control device 51 has the threshold value setting portion 84 which sets the threshold value SL according to the fluid temperature. The threshold setting portion 84 is constituted of an electronic/electric circuit, a computer program, or the like provided in the control device 51.

Figure 12:
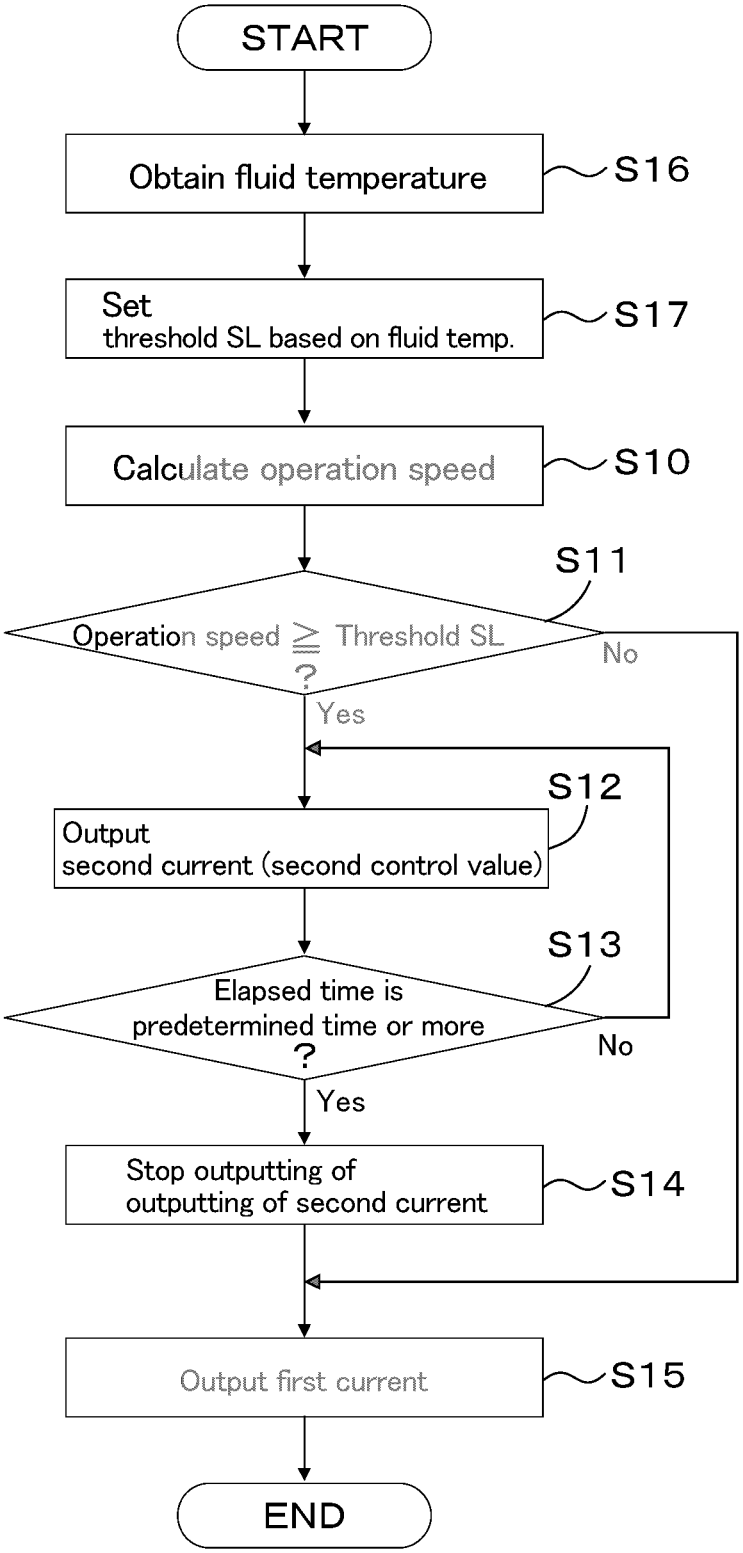
FIG. 12 is a view illustrating a second control flowchart used for controlling the control valve according to the third embodiment.

FIG. 12 shows a second control flowchart of the control valves V1 to V10. As shown in FIG. 12, steps S10 to S15 are the same as those of FIG. 10. As shown in FIG. 12, when the control device 51 acquires the fluid temperature measured by the measurement device 83 (step S16), the threshold setting portion 84 sets the threshold SL based on the fluid temperature (step S17). For example, when the fluid temperature is a low temperature lower than −10° C. and the viscosity of the operation fluid is high, the threshold setting portion 84 shortens the threshold SL as shown in FIG. 11B (decreases the slope of the straight line indicating the threshold SL). In addition, when the fluid temperature is −10° C. or higher and the viscosity of the operation fluid is low, the threshold setting portion 84 increases the threshold SL as shown in FIG. 11B (increases the slope of the straight line indicating the threshold SL). The relation between the fluid temperature and the threshold value is an example, and the numerical value is not limited thereto. Further, although the threshold value setting portion 84 sets the threshold value SL in two levels depending on the fluid temperature, the threshold value SL may be set in multiple levels larger than two levels depending on the values of the fluid temperature. After the threshold value SL is set by the threshold value setting portion 84, the process proceeds to step S10 to step S15.

Figure 13:
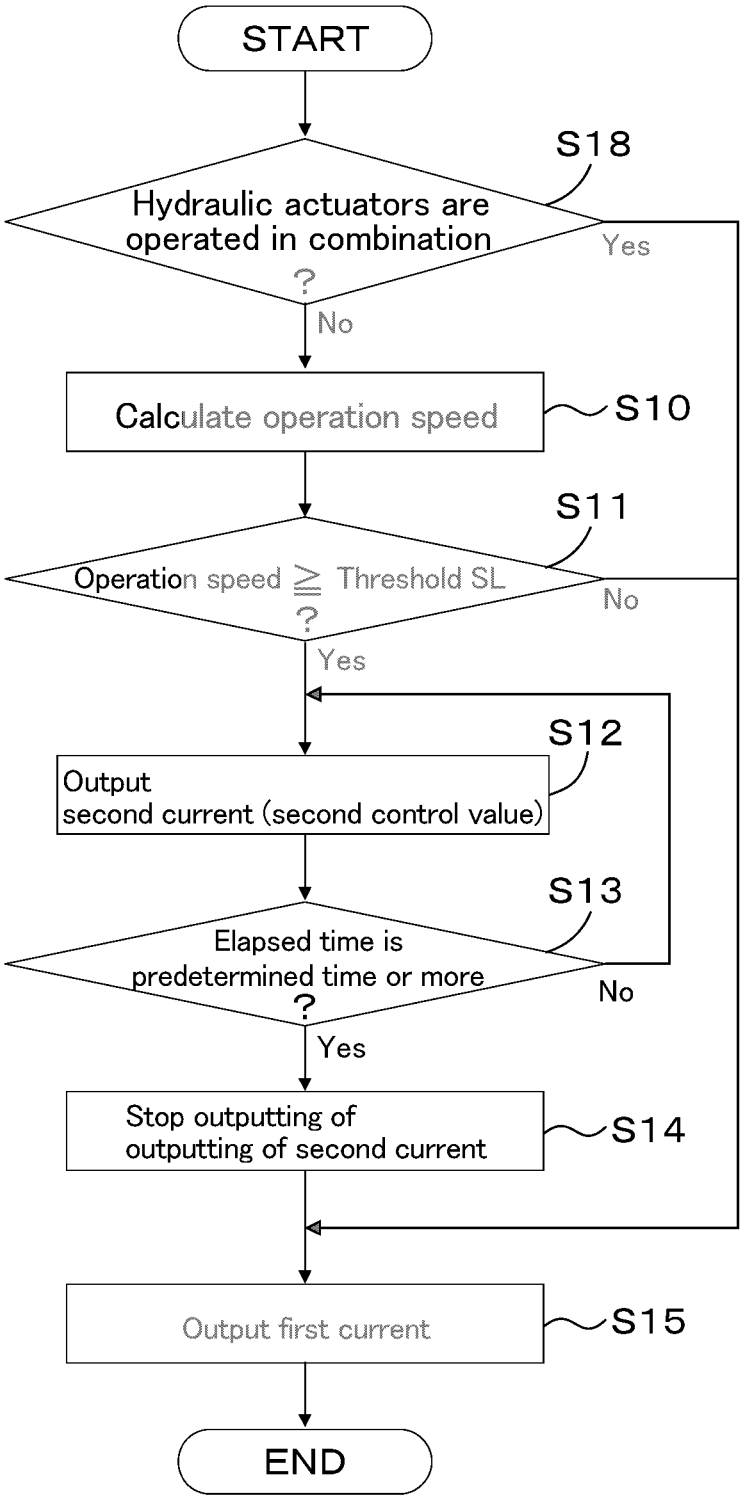
FIG. 13 is a view illustrating a third control flowchart used for controlling the control valve according to the third embodiment.

Note that the controller portion 82 may judge whether to control with the second current value based on the operation pattern of the operation member (for example, whether the operation is a composite operation in which a plurality of hydraulic actuators are operated simultaneously). FIG. 13 shows a third control flowchart of the control valves V1 to V10. As shown in FIG. 13, steps S10 to steps S15 are the same as those of FIG. 10.

As shown in FIG. 13, the controller portion 82 judges whether or not a plurality of hydraulic actuators have been operated in combination (step S18: combined operation judgment). In the combined operation judgment, for example, the controller portion 82 judges whether or not the operation member 19L and the operation member 19R are operated in combination simultaneously. Here, the composite operation refers to a case where the two operation members are swung in combination substantially simultaneously from the neutral position (when the swinging amounts are inputted to the control device 51 substantially simultaneously), a case where one of the two operation members starts to be operated from the neutral position under the state where the one of the two operation members is not operated from the neutral position and the other one of the two operation members is operated, or the like.

When a plurality of hydraulic actuators are operated in combination (step S18, Yes), the controller portion 82 proceeds to step S15 and performs the operation with use of the first control value without performing the control using the second control value. The controller portion 82 proceeds to step S10 when a plurality of hydraulic actuators are not operated in combination (step S18, No), that is, when only one hydraulic actuator is operated. When the operating extent of the operation member at the time of operating one hydraulic actuator exceeds the threshold SL (step S11, Yes), the controller portion 82 performs control based on the second control value as shown in step S12.

That is, when the operation pattern of the operation member is a predetermined pattern (step S18, No), the control device 51 judges whether the control valves V1 to V10 should be controlled based on the first control value or should be controlled based on the second control value depending on whether or not the operation speed of the operation member is less than the threshold value (step S11). On the other hand, when the operation pattern of the operation member is different from a predetermined pattern (step S18, Yes), the control valves V1 to V10 are controlled under the first control value regardless of whether or not the operation speed of the operation member is less than the threshold value. In the above-described embodiment, the operation pattern is the combined operation as the predetermined pattern. However, the operation pattern is not limited to the combined operation.

The controller portion 82 proceeds to S10 when only one hydraulic actuator is operated, but instead may proceed to step S12. That is, when the plurality of hydraulic actuators are not operated in combination (step S18, No), the controller portion 82 may perform the control using the second control value regardless of the operation speed of the operation member.

Note that a hydraulic actuator to be controlled under the second control value may be set in the control device 51, the control may be performed under the second control value when the set hydraulic actuator is operated and the operation speed is equal to or greater than the threshold SL. And, the control using the first control value may be performed without using the second control value even when the operation speed is equal to or higher than the threshold value SL in the hydraulic actuators not being set.

Figure 14A:
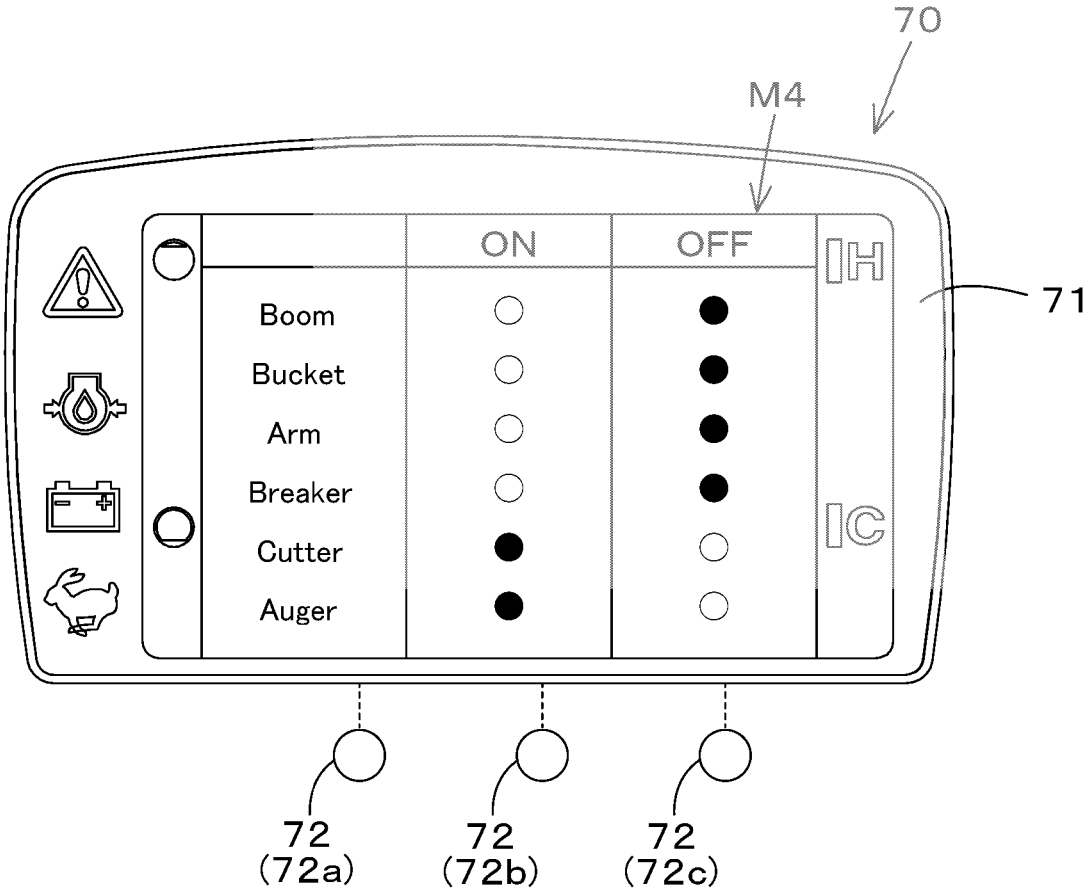
FIG. 14A is a view illustrating a setting screen showing the setting of a hydraulic attachment according to the third embodiment.

FIG. 14A shows a setting screen M4 showing the setting of the hydraulic actuator for the hydraulic attachment. The setting screen M4 displays a plurality of hydraulic attachments and displays ON/OFF corresponding to the plurality of hydraulic attachments. By turning on the operation tool 72 (the first switch 72*a*, the second switch 72*b*, and the third switch 73*c*), ON/OFF of each hydraulic attachment can be set. The relation between each hydraulic attachment set on the setting screen M4 and ON/OFF (whether or not the second control value is used) is stored in the storage portion 60.

Figure 14B:
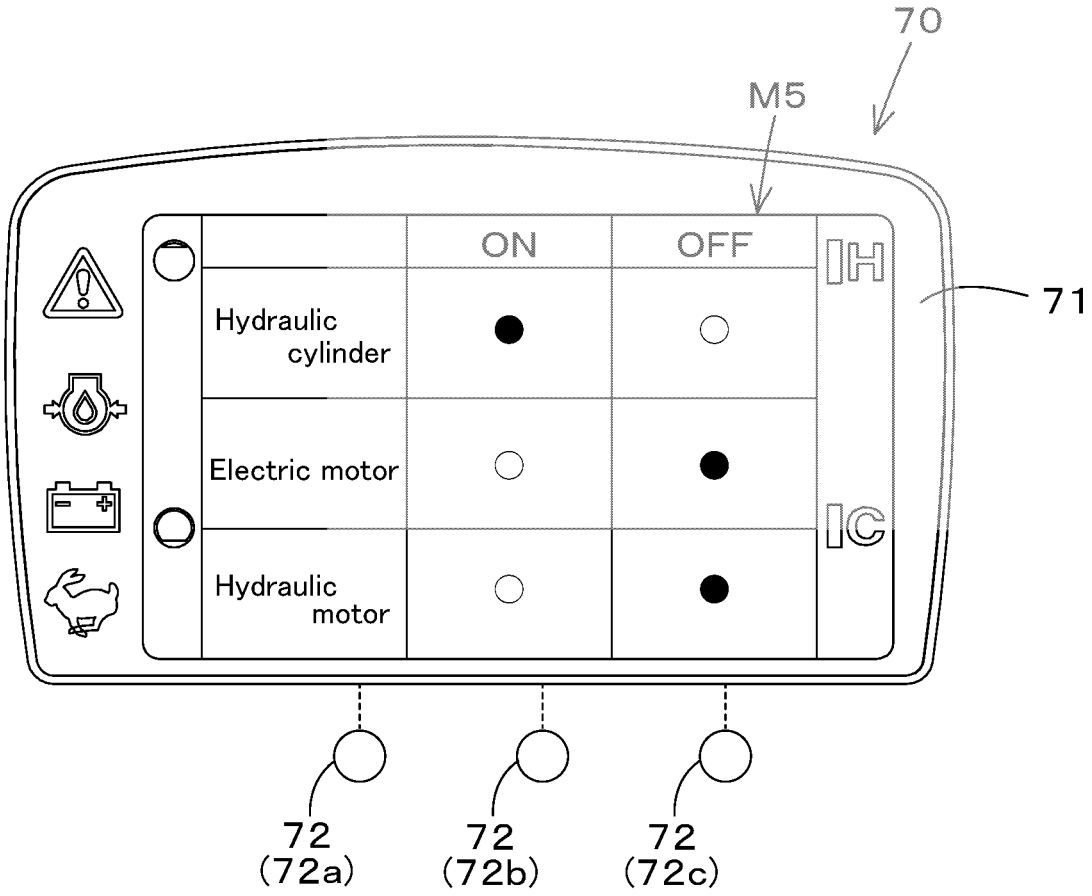
FIG. 14B is a view illustrating a setting screen showing the setting of a hydraulic actuator according to the third embodiment.

FIG. 14B shows a setting screen M5 showing the setting of the hydraulic actuator for the hydraulic attachment. The setting screen M5 displays a plurality of hydraulic actuators and displays ON/OFF corresponding to the plurality of hydraulic actuators. By turning on the operation tool 72 (the first switch 72*a*, the second switch 72*b*, and the third switch 73*c*), ON/OFF of each hydraulic actuator can be set. The relation between each hydraulic actuator set on the setting screen M5 and ON/OFF is stored in the storage portion 60. The "ON" on the setting screens M4 and M5 indicates that the control is performed using the second control value, and the "OFF" on the setting screens M4 and M5 indicates that the control is performed using the second control value.

Figure 15:
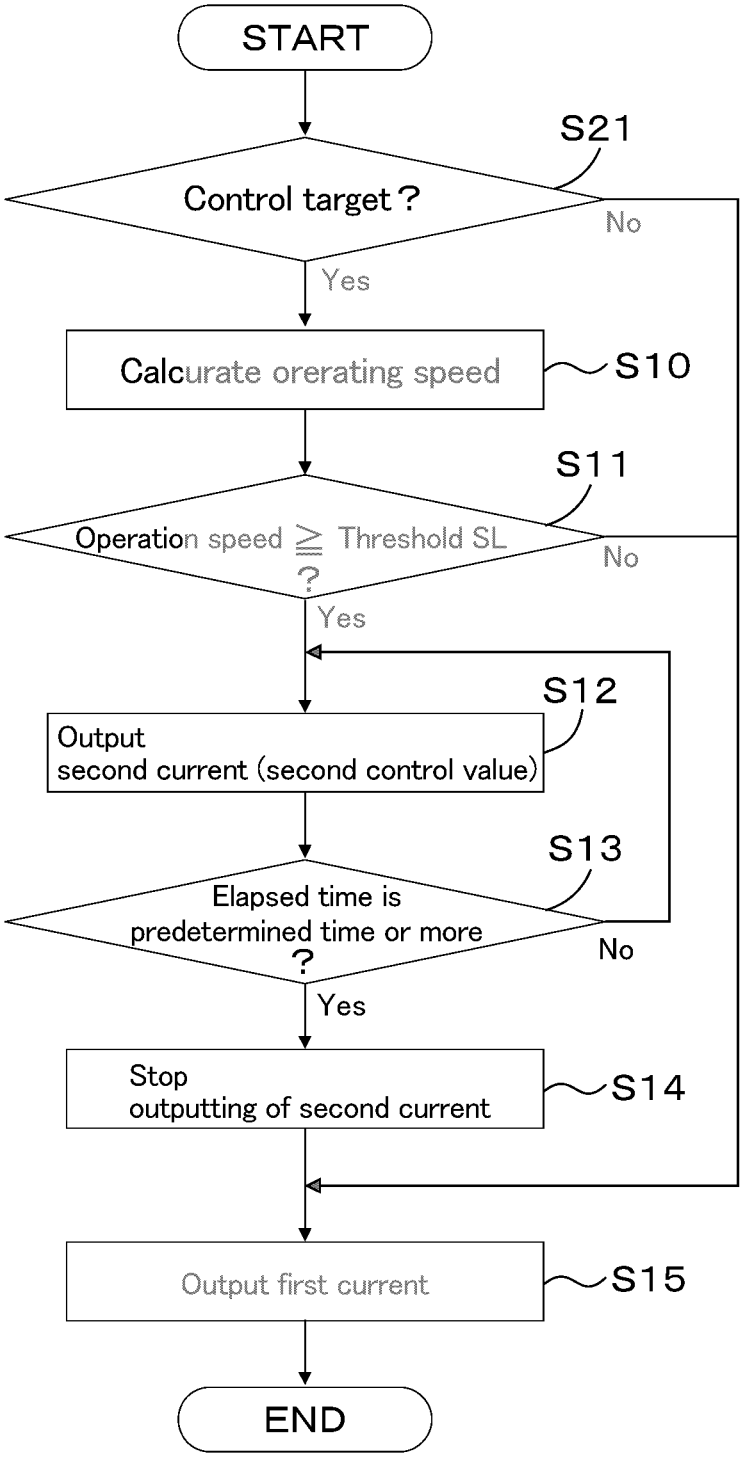
FIG. 15 is a view illustrating a fourth control flowchart used for controlling the control valve according to the third embodiment.

FIG. 15 shows a fourth control flowchart of the control valves V1 to V10. As shown in FIG. 15, steps S10 to S15 are the same as those of FIG. 10.

As shown in FIG. 15, when the operation member is operated, the controller portion 82 refers to the storage portion 60 (step S21), and judges whether the hydraulic actuator corresponding to the operated operation member is the control target under the second control value (step S21). When the hydraulic actuator is the control target (step S21, Yes), the controller portion 84 proceeds to step S10. After that, when the operation speed of the operation member is equal to or higher than the threshold SL (step S11, Yes), as shown in step S12, the controller portion 82 performs the control based on the second control value. On the other hand, when the hydraulic actuator is not the control target (step S21, No), the controller portion 84 proceeds to step S15 and performs the control using the first control value.

That is, as shown in FIG. 15, when the operation member corresponding to the predetermined hydraulic actuator is operated (step S21, Yes), the control device 51 judges whether the control valves V1 to V10 are controlled with the first control value or the second control value depending on whether or not the operation speed of the operation member is less than the threshold value. On the other hand, when the operation member different from the operation member corresponding to the predetermined hydraulic actuator is operated (step S21, No), the control valves V1 to V10 are controlled with the first control value regardless of whether or not the operation speed of the operation member is less than the threshold value.

In the third embodiment, the revolving controller portion 55A, the revolving controller portion 55B, and the like may be applied so that not only the standard control mode but also the integrated control mode can be performed. The engine revolving speed may be set for each hydraulic actuator and for each working through the display device 70. That is, the hydraulic system for the working machine 1 may be constituted of combination of the third embodiment, the second embodiment, and the first embodiment arbitrarily.

Fourth Embodiment

Figure 16:
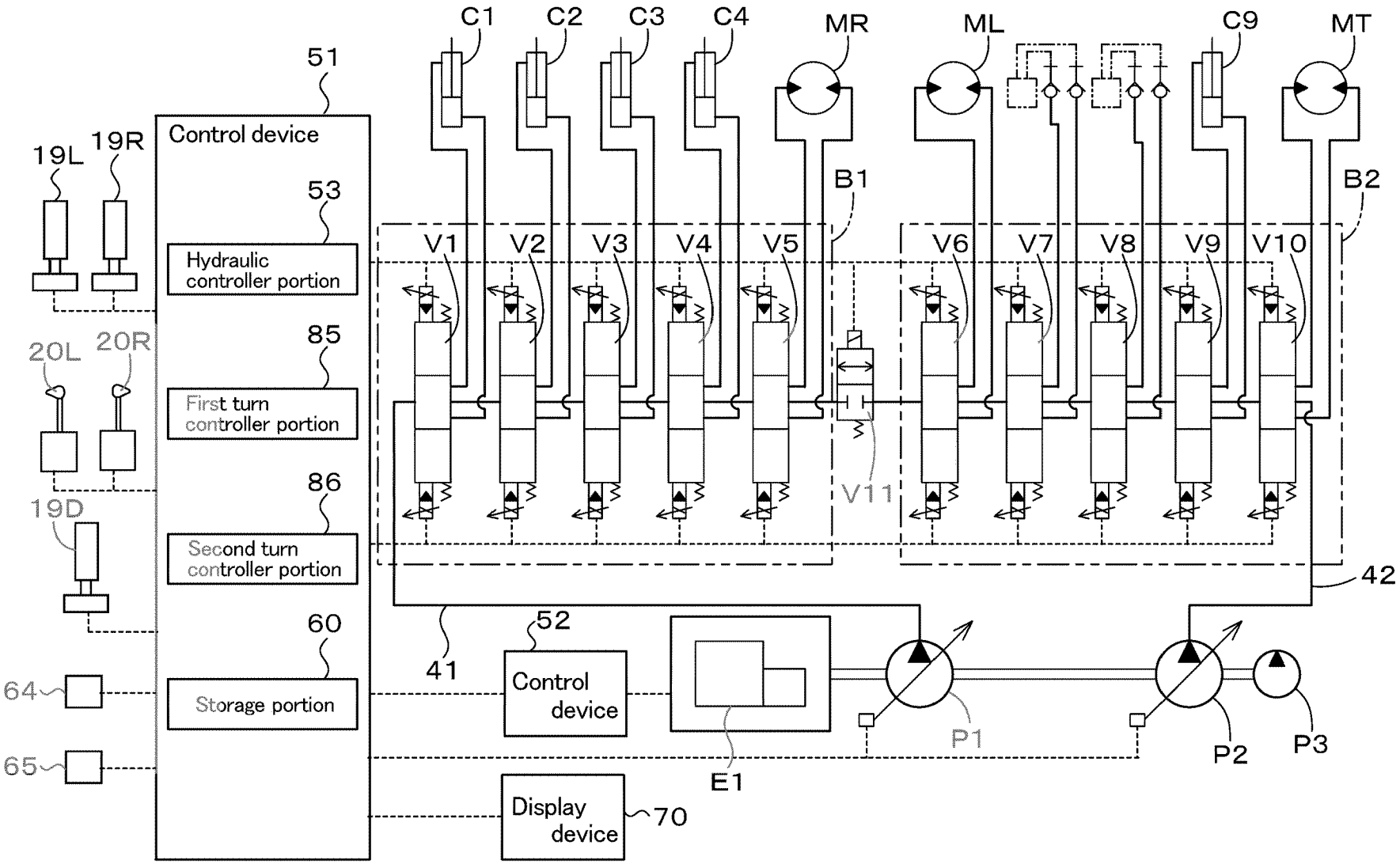
FIG. 16 is a schematic configuration view illustrating a hydraulic system and a control system of a working machine according to a fourth embodiment of the present invention.

FIG. 16 shows a hydraulic system and a control system according to a fourth embodiment of the present embodiment. In addition, description of the configurations same as those of the first embodiment will be omitted.

As shown in FIG. 16, the control device 51 includes a first turn controller portion 85 and a second turn controller portion 86. Each of the first turn controller portion 85 and the second turn controller portion 86 is constituted of an electronic/electric circuit, a computer program, or the like which is provided in the control device 51.

The first turn controller portion 85 sets a target turn speed corresponding to the operating extent of the work operating member 19L, and thereby controls the turn device. The second turn controller portion 86 sets a high turn speed higher than the target turn speed, and thereby controls the turn device.

Figure 17:
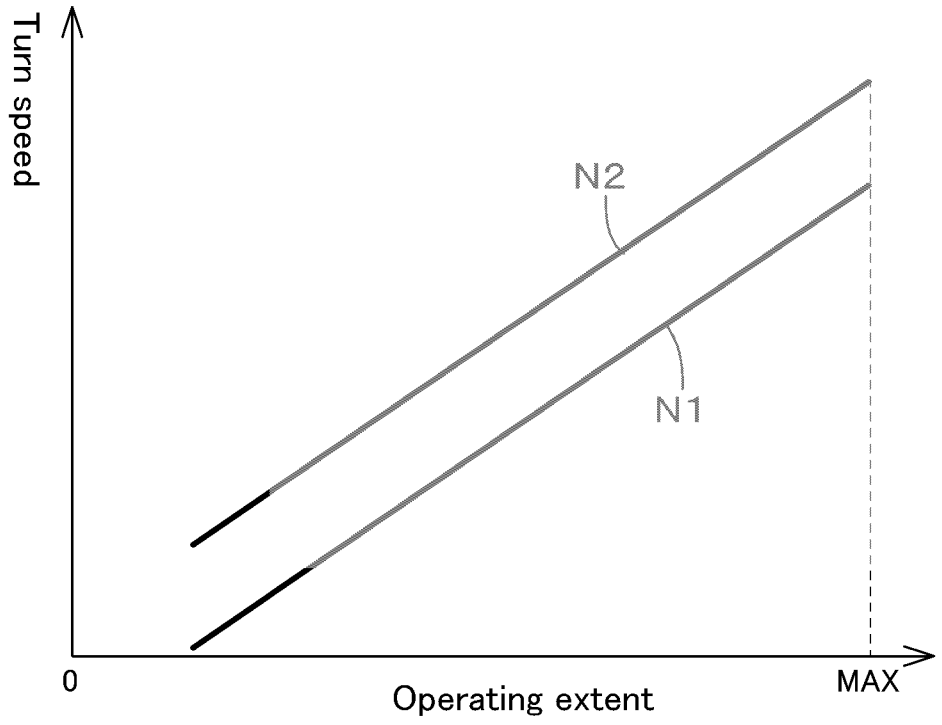
FIG. 17 is a view illustrating a relation between a turn speed and an operating extent of an operating member according to the fourth embodiment.

FIG. 17 shows the relation between the operating extent of the work operating member 19L and the turn speed. As shown in FIG. 17, the first turn controller portion 85 sets the turn control line N1 indicating the target turn speed to a larger value as the operating extent increases. The second turn controller portion 86 sets the turn control line N2 indicating the high turn speed to a larger value as the operating extent increases. When the turn speed indicated by the turn control line N2 is higher than the turn speed indicated by the turn control line N1 in the same operating extent, the high turn speed (the turn control line N2)> the target turn speed (the turn control line N1) is satisfied. The relation between the operating extent of the work operating member 19L and the turn speed (the target turn speed and the high turn speed) shown in FIG. 17 is stored in the storage portion 60.

Figure 18:
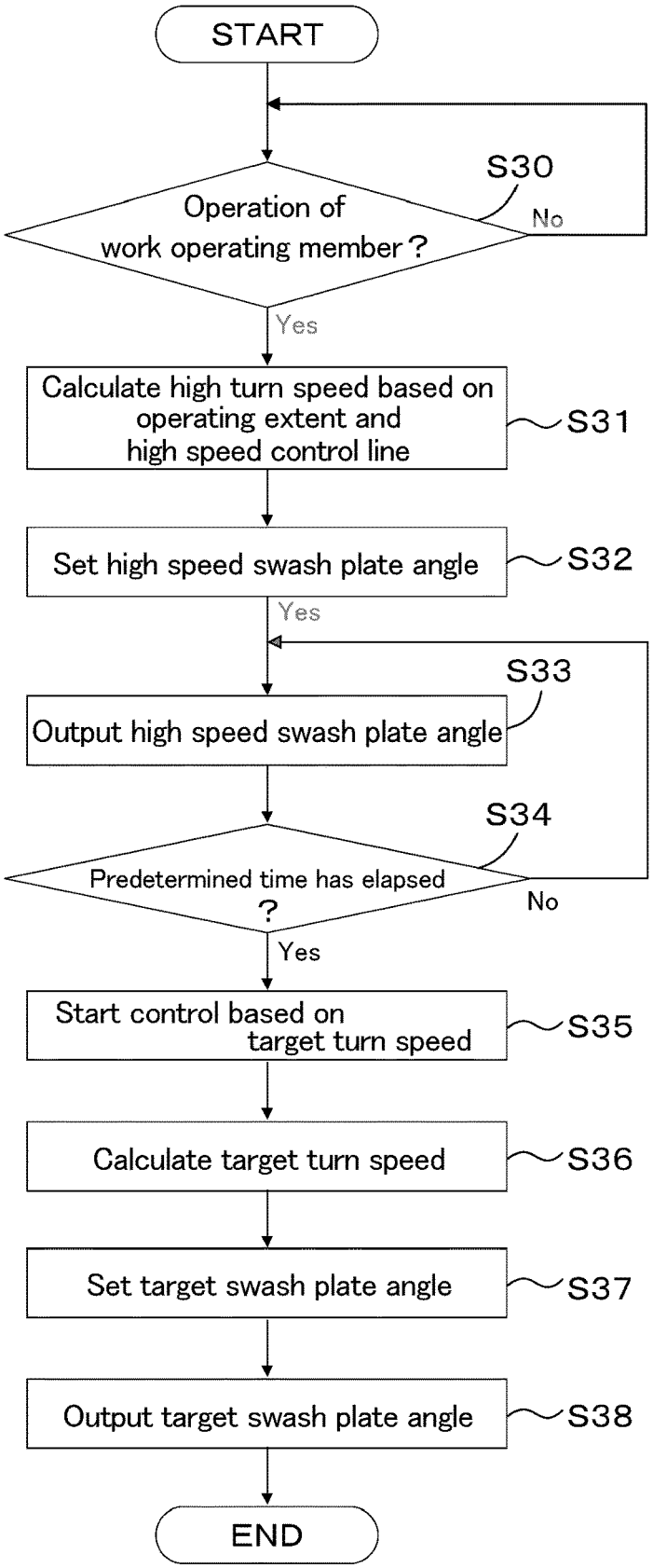
FIG. 18 is a view illustrating a first control flow chart of a turn device according to the fourth embodiment.

FIG. 18 shows a first control flowchart of the turn device.

The control device 51 judges whether or not the work operating member 19L has been operated (step S30). When the work operating member 19L is operated (step S30, Yes), the second turn controller portion 86 refers to the storage portion 60, and calculates the high turn speed based on the operating extent of the work operating member 19L and the turn control line N2 (step S31). The second turn controller portion 86 sets the high speed output of the hydraulic pump corresponding to the high turn speed, that is, the swash plate angle (the high speed swash plate angle) (step S32). The second turn controller portion 86 outputs, to the hydraulic pump, a control signal indicating the high speed swash plate angle (step S33: highspeed output). The control device 51 (the first turn controller portion 85) judges whether or not a predetermined time has elapsed after the start of the control by the second turn controller portion 86, that is, after the high speed output at step S33 (step S34). When the predetermined time has elapsed (step S34, Yes), the control of the turn device is started based on the target turn speed (step S35). The first turn controller portion 85 refers to the storage portion 60, and calculates the target turn speed based on the operating extent of the work operating member 19L and the turn control line N1 (step S36).

The first turn controller portion 85 sets a target output of the hydraulic pump corresponding to the target turn speed, that is, the swash plate angle (the target swash plate angle) (step S37). The first turn controller portion 85 outputs, to the hydraulic pump, a control signal indicating the target swash plate angle (step S38: target swash plate angle). That is, the first turn controller portion 85 controls the turn device based on the target turn speed after the second turn controller portion 86 controls the turn device, and thereby converging the turn speed to the target turn speed.

The control for converging the turn speed to the target turn speed in the first turn controller portion 85 is preferably performed based on an actual turn speed (a real turn speed) of the turn device, that is, the turn base 2. For example, a measurement device 87 configured to measure the real turn speed of the turn device (the turn base 2) is connected to the control device 51. The first turn controller portion 85 obtains a difference (a speed difference) between the target turn speed and the real turn speed measured by the measurement device 87, and corrects the target swash plate angle so that the speed difference becomes zero. In this manner, the real turn speed is matched with the target turn speed.

Japanese Laid-Open Patent Publication No. 2000-266006 discloses a working machine including a turn body, a turn lever for the turning operation of the turn body, and a turn motor for rotationally driving the turn body. In addition, the turn control device provided in the working machine outputs a relief pressure setting signal when the operating extent of the turn lever is equal to or greater than a predetermined value, thereby increasing the pressure of the operation fluid flowing into the turn motor from a low set pressure to a high set pressure.

However, the working machine disclosed in Japanese Patent Laid-Open No. 2000-266006 controls the rotation of the turn motor by changing the setting of the relief pressure in the hydraulic circuit, and thus sufficient control accuracy of the turn operation cannot be obtained.

In contrast, in the above-described embodiment of the present invention, the responsiveness of the turn motion according to the operation of the operation member can be improved.

That is, the control device 51 includes the first turn controller portion 85 and the second turn controller portion 86. In addition, the first turn controller portion 85 controls the turn device based on the target turn speed after the turn device is controlled by the second turn controller portion 86. Thus, when the work operating member 19L is operated, the turn speed of the turn base 2 can be quickly reached to the target turn speed by the first turn controller portion 85 and the second turn controller portion 86. In addition, since the high turn speed is converged to the target turn speed based on the actual turn speed measured by the measurement device 87 and the target turn speed, the turn speed can be converged stably. In addition, when the hydraulic pump is a variable displacement pump, the response speed is slow, so the turn speed of the turn base 2 may be slow at the initial movement stage of the turn base 2. However, since the second turn controller portion 86 performs the turn control at the high turn speed in the initial movement stage of the turn base 2, the lowering of the turn speed can be suppressed in the initial movement stage, and the turning action of the turn base 2 can be quickly performed.

Note that the turn device may be controlled based on the operation speed of the work operating member. As shown in FIG. 16, a speed detector portion 81 is provided. The speed detector portion 81 is the same as that of the above-described embodiments.

Figure 19:
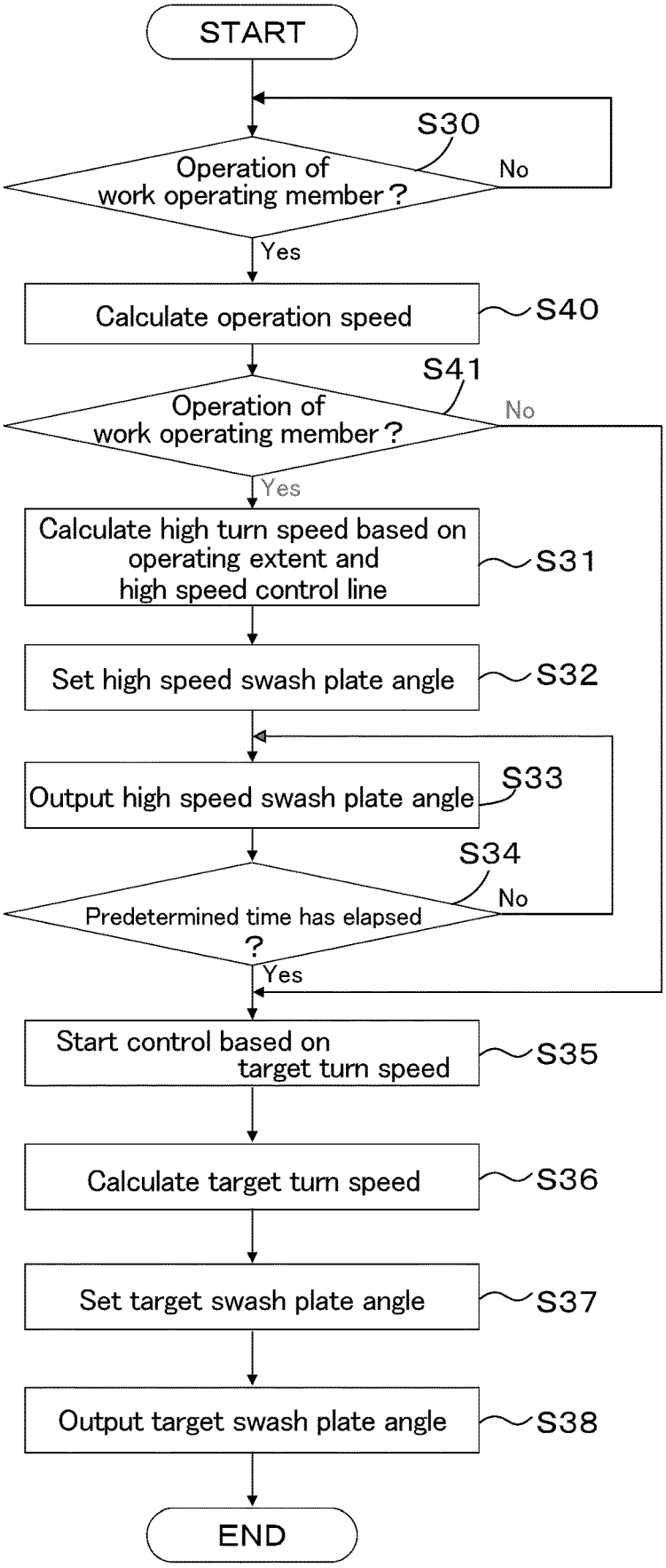
FIG. 19 is a view illustrating a second control flow chart of the turn device according to the fourth embodiment.

FIG. 19 shows a second control flowchart of the turn device. In FIG. 19, step S30 and steps S31 to S38 are the same as in FIG. 18. As shown in FIG. 19, when the work operating member 19L is operated (step S30, Yes), the speed detector portion 81 detects the operation speed of the work operating member 19L (step S40). The control device 51 judges whether or not the operation speed of the work operating member 19L is equal to or higher than a threshold value (step S41). When the operation speed is equal to or higher than the threshold value (step S41, Yes), the control device 51 progresses the processing to step S31 and executes the control using the high turn speed by the second turn controller portion 86 (steps S31 to S34). On the other hand, when the operation speed is less than the threshold value (step S41, No), the control device 51 progresses the process to step S35 and executes the control using the target turn speed by the first turn controller portion 85 (steps S35 to S38).

According to the above embodiments, when the work operating member is operated rapidly, the turn speed of the turn base 2 can be quickly reached to the target turn speed.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modified examples within and equivalent to a scope of the claims.

What is claimed is:

1. A working machine comprising:

a prime mover;

a hydraulic pump to be driven by power of the prime mover and to output operation fluid;

an accelerator setting member to set a target revolving speed of the prime mover;

a hydraulic actuator to be operated by the operation fluid; and a control device having:

a revolving-speed controller to increase and decrease a revolving speed of the prime mover so as to correspond to at least a load applied on the hydraulic pump;

a first setting portion to set a limit value of the revolving speed of the prime mover; and a revolving-speed limiter to limit the revolving speed of the prime mover set by the revolving-speed controller to the limit value set by the first setting portion, wherein the control device further has:

a switching portion to selectively set either one of:

a first state allowing the revolving speed of the prime mover to be increased and decreased by the revolving-speed controller; and a second state preventing the revolving speed of the prime mover from being increased and decreased by the revolving-speed controller; and a second setting portion to set the revolving speed of the prime mover to the target revolving speed set by the accelerator setting member when the second state is set by the switching portion, and when the first state is set by the switching portion, the revolving-speed controller automatically increases or decreases a revolving speed of the prime mover according to not a target revolving speed of the prime mover set by the accelerator setting member but another target revolving speed of the prime mover set based on a required flow rate of the operation fluid output from the hydraulic pump to operate the hydraulic actuator such as to correspond to the load.

2. The working machine according to claim 1, wherein the first setting portion sets the limit value in association with the hydraulic actuator or working contents to be operated.

3. The working machine according to claim 1, comprising a setting member to be operated by an operator to set a control value relating to the working machine, wherein the setting member is used for setting a working content other than the control value when the second state is set by the switching portion.

4. The working machine according to claim 3, wherein the setting member is used for setting a flow rate of the operation fluid to be outputted from the hydraulic pump when the second state is set by the switching portion.

5. The working machine according to claim 1, wherein the first setting portion sets the limit values corresponding to at least two hydraulic actuators to values different from each other when the limit values are set for each of the hydraulic actuators.

6. The working machine according to claim 1, wherein the first setting portion sets the limit values corresponding to at least two working contents to values different from each other when the limit values are set for each of the contents of working.

* * * * *